US007128233B2

(12) United States Patent
Hogan

(10) Patent No.: US 7,128,233 B2
(45) Date of Patent: Oct. 31, 2006

(54) TAMPER-RESISTANT CONTAINER AND METHODS

(76) Inventor: Jamie Hogan, 3662 Marlesta Dr., San Diego, CA (US) 92111

( * ) Notice: Subject to any disclaimer, the term of this patent is extended or adjusted under 35 U.S.C. 154(b) by 36 days.

(21) Appl. No.: 10/669,677

(22) Filed: Sep. 23, 2003

(65) Prior Publication Data

US 2005/0061816 A1 Mar. 24, 2005

(51) Int. Cl.
*B65D 41/04* (2006.01)

(52) U.S. Cl. ..... 220/288; 215/218

(58) Field of Classification Search ..... 215/213, 215/214–223; 220/288, 730, 289, 290
See application file for complete search history.

(56) References Cited

U.S. PATENT DOCUMENTS 3,595,427 A * 7/1971 Markowitz ..... 220/288
3,741,421 A * 6/1973 Wittwer ..... 215/217
3,782,574 A * 1/1974 Rumble ..... 215/223
3,828,957 A * 8/1974 Marchant ..... 215/223
3,893,582 A * 7/1975 Kowalik ..... 215/221
3,901,412 A * 8/1975 Copia ..... 222/182
4,053,077 A * 10/1977 DeFelice ..... 215/217
4,203,479 A 5/1980 Mathews
4,298,129 A * 11/1981 Stull ..... 215/224
4,801,039 A 1/1989 McCall et al.
5,078,288 A * 1/1992 Fuchs ..... 215/209
5,344,109 A 9/1994 Hokoana, Jr.
5,411,161 A 5/1995 Fish, Jr.
5,462,182 A * 10/1995 Opresco ..... 215/216
5,526,947 A * 6/1996 Stolz ..... 215/213
5,544,768 A * 8/1996 Gargione ..... 215/209
5,638,977 A 6/1997 Bianchi
5,687,863 A * 11/1997 Kusz ..... 215/216
5,706,963 A * 1/1998 Gargione ..... 215/219
5,829,609 A * 11/1998 Beck ..... 215/217

(Continued)

OTHER PUBLICATIONS

Backcountry.com Garcia Machine Backpackers' Cache Bear Resistant Food Container web pages/information, no date, 2 pages, www.backcountry.com.

(Continued)

*Primary Examiner*—Lien M. Ngo
(74) *Attorney, Agent, or Firm*—Gazdzinski & Associates

(57) ABSTRACT

An improved container designed to provide all of the foregoing attributes (including light weight, low cost, ease of use and carrying, and climatic tolerance) while also presenting a virtually impenetrable barrier to animals. One exemplary embodiment comprises a highly resilient, lightweight, one piece polymer (polycarbonate) body or shell having a large-diameter aperture disposed at one end. A threaded, partially flexible lightweight polymer cap element mates with the body; the cap element comprises a tamper-resistant configuration with locking features which prevent rotation of the cap with respect to the body past a certain point. A ridge is formed on the body along the mating region of the cap, the ridge acting to prevent any animal (or human for that matter) from being able to insert anything (e.g., claws) under the cap when installed to pry it off. The locking features, ridge, body, and cap coordinate to make the container pliable enough to distort without opening, yet resilient and rugged enough to prevent permanent deformation, fracture, or cracking even under the weight (and motive forces) of a fully grown bear.

25 Claims, 18 Drawing Sheets

U.S. PATENT DOCUMENTS 5,884,815 A * 3/1999 Stolz ..... 222/153.14
5,950,981 A 9/1999 Judy
5,988,413 A * 11/1999 Nagel ..... 215/216
6,003,700 A * 12/1999 Julian et al. ..... 215/216
6,016,930 A * 1/2000 Mathes et al. ..... 215/216
6,036,036 A * 3/2000 Bilani et al. ..... 215/216
6,332,713 B1 12/2001 Cohen
6,343,709 B1 2/2002 DeForrest et al.

OTHER PUBLICATIONS

Ursack TKO web page/information, no date, 1 page, www.ursack.com.
Wild Ideas web pages/product information for the "Bearikade Expedition MKII"and "Bearikade Weekender MKII", no date, 2 pages, www.wild-ideas.net.

* cited by examiner

TAMPER-RESISTANT CONTAINER AND METHODS

COPYRIGHT

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

This invention relates generally to the field of containers adapted to selectively restrict access thereto, and specifically in one exemplary aspect to animal-proof containers for supplies and other materials including, inter alia, food.

2. Description of Related Technology

Under many circumstances, it is desirable to store supplies and materials in a container such that access to the supplies or materials is selectively controlled. This is true of a broad variety of materials including chemicals, pharmaceuticals, and notably supplies taken on outdoor excursions. One particularly difficult application of such "selective access" technology relates to the storage of food and supplies during hiking and camping excursions into wilderness areas where animals are present. Many of these animals, including most notably members of the *ursa* species (commonly referred to as bears), are amazingly adept at gaining access to such storage containers. Instances of bears ripping apart containers and even automobiles to get at food stored within are now commonplace. The bear is particularly adept at leveraging its great strength, weight, sharp teeth and claws to gain access to literally any type of container. Bears are often excellent climbers as well, thereby affording them substantial mobility in all three dimensions.

While not only destructive and costly, such surreptitious access by bears is also detrimental to the bear population, since (i) the bears can become dependent on the ill-gotten food provided by humans, thereby reducing their ability and tendency to obtain food via natural sources; and (ii) the bears can become increasingly aggressive in their attempts to obtain food, thereby sometimes necessitating their termination as a danger to humans. Aside from the foregoing, even a "low intensity" encounter with a bear seeking food can be traumatic to the hiker or camper, and represents another danger thereto. Many a camping or hiking trip has also been ruined through unexpected loss of supplies, even where no confrontation occurs.

Accordingly, more extreme measures have been implemented in recent years to mitigate the foregoing detriments and threats to both humans and bears. For example, Federal law now requires proper storage of food throughout National Parks (such as the well known Yosemite National Park). The National Park Service strongly advises all backpackers to carry and use approved bear-resistant food storage canisters instead of other traditional methods such as slinging the food/supplies over an elevated tree limb, etc. In some areas use of bear-proof canisters is required (such as above certain elevations within Yosemite).

In response to the aforementioned surreptitious intrusion and access to food and supplies by bears, a variety of different "bear exclusion" technologies have arisen over the years. These are generally classified into three (3) discrete categories: (i) anti-bear canisters; (ii) anti-bear bags; and (iii) hanging or elevated storage. These devices are generally subject to approval by relevant oversight organizations such as SIBBG or SEKI.

Several different types of anti-bear canisters have been developed or proposed. Three commercially available types include the Garcia Model 812 Backpackers' Cache, the so-called "Bearikade" manufactured by Wild Ideas, Inc., and the Tahoe model from Purple Mountain Engineering, Inc. of Palmdale, Calif.

The Model 812 device 100 (FIG. 1) is generally cylindrical in shape, yet with a decided taper from the center region 102 toward its ends (thereby giving somewhat of a "beer barrel" appearance). The completely opaque (black) device is manufactured via an injection molding process, wherein two half-sections are formed of a polymer (Acrylonitrile Butadiene Styrene, or ABS) and then bonded together via an adhesive. In terms of access, one end of the container includes an aperture 104 significantly smaller than the outer diameter of the container, thereby creating a fairly broad rim or lip 106 around the periphery of the aperture. An access hatch or cover 108 is mated into the aperture, using an insert tab and two opposed, mechanically actuated locking mechanisms 110 to secure the cover in place. A screwdriver, coin, or other similar device is required to actuate the mechanisms.

Unfortunately, the Model 812 device suffers from several disabilities, including the aforementioned taper of the container, which makes carrying very difficult (e.g., restraining straps tend to slide off the container due to the taper). A corresponding carrying case is sold (Model C-12 Carrying Case) in order to carry the Model 812 device, attesting to its difficulty to carry or restrain without an external case. Whether by design or otherwise, this approach adds additional cost to the solution.

The Model 812 design also utilizes the aforementioned cover as part of the structural integrity of the container, the cover 108 bearing some of any compressive force applied to the container as a whole. Unfortunately, the cover can be dislodged when enough lateral compressive force is applied (such as a heavy bear standing on the side of the device with its weight on its front paws). This effect results primarily from differential distortion of the container and the cover.

Another disability associated with the Model 812 device is due to the aforementioned cover 108 being recessed in an aperture is the tendency for rainwater to collect in this recess and enter the container, wetting and spoiling the contents.

Another disability associated with the Model 812 device is the substantially restricted access provided to the user. Specifically, the thick rim or lip 106 previously described acts to make items inserted or removed via the aperture more likely to catch or be hung up on the rim. This is especially true of non-cylindrical or round items, such as freeze-dried food pouches or the like. The edges of such items tend to catch on the rim of the container, thereby requiring the user to fold or bend the item for easier insertion/removal. This is particularly frustrating and debilitating when removing the items from the container, since the aperture is sized not much larger than the diameter of the average human fist, thereby making manipulating such items awkward (or otherwise necessitating "pre-forming" them, such as by using rubber bands or the like).

Additionally, the locking mechanisms 110 of the Model 812 are difficult to operate, and require a separate tool. They also must be properly aligned to replace the cover onto the container body, and are potentially subject to fouling with dirt or other foreign materials. Such locking mechanisms are also comparatively expensive to manufacture.

Additionally, the need to bond the two half sections of the Model 812 together also requires a substantial butt joint that introduces extra bulk and weight to the design with a reduction in useful interior volume (and therefore food capacity).

Lastly, the Model 812 device is also comparatively heavy, owing in large part to the injection-molded/adhesive technology it utilizes. Specifically, in order for the container (and particularly the bonded seam) to sustain sufficient lateral or longitudinal loading, the container material must be made comparatively thicker, especially since it is designed for minimum flexing (i.e., the ABS is not very flexurally robust). This added thickness significantly increases the weight of the container.

The aforementioned "Bearikade®" device 200 (FIG. 2) has a generally similar construction to the Model 812, in that it is substantially cylindrical, and utilizes rotated locking mechanisms 202 to seal the cover 204 to the canister 206. See the discussion of U.S. Pat. No. 6,343,709 provided subsequently herein. However, its shape is cylindrical (no seeming taper), and the container is fabricated using a comparatively complex and expensive technology. Specifically, the container is made of a composite sandwich using an offset seam, taper rolling technique. The container is also cured in autoclave at elevated temperature and pressure. The Bearikade end components principally consist of a 6061 T-6 aluminum hatch, locking collar, and end fittings bonded to the composite carbon-fiber cylinder with high strength epoxy. O-rings are used between the fasteners and hatch, and between the hatch and locking collar. When sealed properly (the seal must not have any debris on the O-rings), the O-rings are under compression and offer a seal against water.

While having good access at the access aperture, the Bearikade device suffers primarily from high cost and complexity of manufacturing, the former being several times the cost of the Model 812 device previously described. It (Bearikade) similarly uses mechanically actuated locking mechanisms (3) which must be operated with a tool or coin. Furthermore, the device is not well adapted to climatic changes in pressure; the aforementioned O-rings, while useful for preventing water intrusion (due in part to the pressure differential across the cover acting to more tightly seal the O-rings when the canister is submerged), also can make the device difficult to open when it is sealed at higher elevation (lower pressure), and then transported to a lower elevation (higher pressure). This "vacuum bottle" effect is highly undesirable.

The Purple Mountain Engineering (PME) "Tahoe" bear canister is made from 6061 aluminum. The canister body is heat treated after assembly, and the top is TIG (Tungsten Inert Gas) welded to the canister body. The cover (lid) is hinged (stainless steel riveted to the top and lid). Closure of the lid is accomplished by a DZUS fastener rated at 600 pounds closure force. As with the other prior art solutions, the Tahoe suffers from several disabilities, including complexity, comparatively high cost and heavy weight (two pounds, six ounces) and small capacity.

The so-called "Ursack®" device is generally representative of the state-of-the-art in anti-bear sack technology. The Ursack TKO model is made of spectra fabric and bolstered with flexible fiberglass ripstop. The standard Ursack is made from aramid fibers woven to enhance puncture and tear resistance to ostensibly thwart a bear's teeth, claws, and strength. However, the Ursack has the flaws of providing no rigid support to protect the materials contained within, and the aramid or other fibers are comparatively costly to manufacture. The Ursack has also proven less than completely effective at frustrating bear intrusion, and also requires that the device be tied to a tree or other immovable structure (lest the bear merely carries the sack off for later efforts at intrusion). See the discussion of U.S. Pat. No. 6,332,713 provided subsequently herein.

A variety of technologies related to animal exclusion and tamper-resistant/sealed containers are present in the patent prior art as well. For example, U.S. Pat. No. 4,203,479 to Mathews issued May 20, 1980 and entitled "Trash bag protector" discloses a device for protecting filled trash bags from attacks by dogs or other animals. The device has a collapsible mesh frame composed of interwoven plastic strands and which presents an open top defined by an upper rim. The open top is closed by eight equally spaced straps whose outer ends are attached to the rim. The inner end of one of the closure straps is provided with an upstanding post upon which the inner ends of the other straps can be installed. Thus installed, the straps extend radially outwardly from the post to the rim and may be locked in place, thereby securing the bags in the protector device.

U.S. Pat. No. 4,801,039 to McCall, et al. issued Jan. 31, 1989 and entitled "Animal proof container" discloses an animal proof container comprising a can having a bottom, a sidewall having an inside surface having a plurality of substantially flat portions each having a recess defined thereby, an outside surface having a corresponding plurality of holes communicating to the recesses and a rim defining an open top. A lid of the container has a cover portion adapted to cover the open top of the can and a plurality of members extending downwardly peripherally from the cover portion, fitting adjacent the inside surface of the can and having lower end portions adjacent the flat portions of the inside surface, the lower end portions being biased outwardly towards the flat portions sufficiently to proceed into the recesses when the lid is pushed fully downwardly onto the can. The lid is biased normally upwardly relative to the can sufficiently for preventing the lower end portions from entering the recesses. Food stored in such a container is ostensibly protected from the attacks of animals, including large animals such as bears. The container can also be made relatively light in weight.

U.S. Pat. No. 5,344,109 to Hokoana, Jr. issued Sep. 6, 1994 and entitled "Apparatus for the engagement and suspension of a bag above the ground for the suspendable storage of items within the bag" discloses an apparatus for suspending conventional trash bags and other bags above the ground for the storage and/or disposal of a variety of items including camping supplies and food. The apparatus comprises a support frame for securing the rim of the bag thereto and suspension arms coupled to the support frame through the use of engagement hooks for hanging the bag above the ground. The support frame comprises a first aperture for insertion of the rim of the bag therethrough, the rim wrapped around the sides of the support frame such that the bag opens through the first aperture. To protect the items inside the bag from weather and animals, the apparatus further includes a cover frame with a second aperture disposed on top of the support frame and a lid for covering the second aperture. With this arrangement, the engagement hooks are used to engage and secure the corresponding corners of the support frame and the cover frame with the rim of the bag firmly secured therebetween. The apparatus may further include upholding means for coupling one end of the suspension arms together and engaging a support structure for suspension of the apparatus, the upholding means comprising one of a variety of attachment members and having a length adjustment member for facilitating attachment of the apparatus to an appropriate support structure.

U.S. Pat. No. 5,411,161 to Fish, Jr. issued May 2, 1995 and entitled "Container having a twist-locking cover" discloses a refuse device includes a cover which can be locked to the container of the device by rotating the cover on the container. The cover includes a top portion, a collar extending downwardly from the top portion, and two tabs attached to the collar, spaced apart from the top portion, located opposite each other, and extending inwardly from the collar. The container includes a sidewall terminating in an upper edge, a closed bottom attached to the sidewall opposite the upper edge, an outwardly extending rim attached to the upper edge of the sidewall, and an upwardly extending lip attached to the rim opposite the sidewall. The lip includes two diametrically opposite channels through which the tabs move when the cover is placed on or removed from the container. The lip also includes six grooves, two of which flank the first channel, two of which flank the second channel, and two of which are positioned intermediate the first and second channels. The latches rest within the two intermediate groove when the cover is first placed on the container. The latches rest in two of the grooves flanking the channels when the cover is locked to the container. In this locked position, the cover cannot be lifted from the container, and resists rotation on the container.

U.S. Pat. No. 5,638,977 to Bianchi issued Jun. 17, 1997 and entitled "Assembly for securing a lid to a container" discloses a lid to be attached to a container, a garbage can for example, wherein the lid is secured by means of a system comprising holes placed in the lid rim in alignment with corresponding holes in the top of the container. A conduit is provided on the underside of the lid in alignment with the holes in the lid and the holes in the container. A securing rod passes through the conduit and the holes in the lid and container to secure the lid to the container. In use, the holes of the lid rim and the holes of the container are in registration with each other.

U.S. Pat. No. 5,950,981 to Judy issued Sep. 14, 1999 and entitled "Bear bag system" discloses a bear bag system for protecting a supply of food while camping. The device includes a length of nylon rope having opposing free ends. A bag of rocks is securable to one of the free ends of the length of nylon rope. Two supplemental bags are provided for storing food. Two lengths of curtain cord adjustably couple the supplemental bags with respect to the length of nylon cord.

U.S. Pat. No. 6,332,713 to Cohen issued Dec. 25, 2001 and entitled "Lightweight bear bag" discloses a lightweight food sack (e.g., the aforementioned "Ursack") made from puncture and tear resistant fabric sewn with high strength thread and secured with an abrasion resistant cord. The food sack is closed by tightening the cord, which encircles the top of the sack in a hem and emerges through a grommet. The cord is secured by means of a cord lock and an overhand knot (20). Excess cord is then tied with a secure knot to a fixed object, such as a tree, so that the sack cannot be removed by a bear.

U.S. Pat. No. 6,343,709 to DeForrest, et al. issued Feb. 5, 2002 and entitled "Impact resistant sealable container" discloses an impact resistant, sealable canister (the aforementioned "Bearikade" being one embodiment thereof) comprising a wall structure having a lower edge portion joined to a base. A receiving collar is joined to an opposing top edge portion of the wall structure. The receiving collar includes an annular channel and an inner shoulder having fastener pads. The pads have fastener openings and stationary connector elements. A container lid releasably seals against the collar by operation of fastener parts retained in the lid that engage the collar connector elements. Gasket materials adjacent the collar periphery and around the fastener parts function to provide a reusable sealed canister useful for water activities and other outdoor involvements.

Despite the variety of different techniques existing under the prior art, there still exists a need for an animal exclusion container, ideally having the following attributes: (i) light weight; (ii) low cost; (iii) ease of access (i.e., no particular tools required); (iv) ready access for objects of varying shape and composition); (iv) ease of carrying; and (v) climatic flexibility and resistance.

SUMMARY OF THE INVENTION

The present invention satisfies the aforementioned needs by providing an improved tamper-resistant lightweight apparatus and methods for operating, handling and manufacturing the same.

In a first aspect of the invention, an improved animal excluding apparatus is disclosed, generally comprising: a body having an interior volume and an aperture formed therein; and a threaded cap having at least one locking element associated therewith; wherein the cap threads onto the body. In one exemplary embodiment, the body and cap are each one-piece molded polymer components, with the body being a rugged yet lightweight and low cost polycarbonate, and the cap being formed of glass-reinforced nylon. The cap is designed to be very low profile, and virtually eliminate any gap between itself and the body that the animal might exploit. An exclusion ridge is formed proximate to cap at the gap, thereby further frustrating attempts by the animal to pry the cap off the body. The cap and body are each sufficiently rugged and flexible to withstand the onslaught of a full grown bear without compromise or damage to the components (or the bear).

In a second aspect of the invention, an improved animal-resistant cap is disclosed. In one exemplary embodiment, the cap comprises a unitary, low profile, threaded component formed of a lightweight polymer (e.g., glass-reinforced nylon) and having a locking element adapted to cooperate with a corresponding element formed on the body of the container on which the cap is threaded. In a second embodiment, the cap comprises an assembly having an outer (cap) element and an inner ring structure; the cap element and ring structure cooperate to allow opening of the container (removal of the cap) under the application of downward force coupled with rotation.

In a third aspect of the invention, a method of operating an animal excluding container is disclosed. In the exemplary embodiment, the container has a body and threadedly engaged cap, the container comprising first and second interfering locking elements, and the method generally comprises: applying force to the cap in at least one region to reduce the interference between locking elements; and rotating the cap in cooperation with the act of applying, the rotating causing the locking elements to change relative position thereby allowing further rotation of the cap. The locking elements comprise, e.g., raised features disposed on the cap and body proximate one another. By distorting the cap slightly and rotating the cap at the same time, sufficient clearance between the raised features is created, thereby allowing them to pass one another (and unlock the cap). This movement requires dexterity not present in a bear or most other species.

In another embodiment, the locking elements comprise a cooperating cap and ring structure which require coordinated application of downward force along with rotation of the cap.

In a fourth aspect of the invention, an improved method of manufacturing a tamper-resistant container apparatus is disclosed. In the exemplary embodiment, the method comprises: forming a unitary body having an aperture therein and a first locking element thereon; forming a cap element adapted to threadedly engage the body, the cap element having a second locking element thereon, and threading the cap element onto the body such that the first and second locking elements cooperate to frustrate subsequent removal of the cap by other than adult humans. In the exemplary embodiment, the body is formed (as one piece) from polycarbonate using a first molding process, while the cap is formed from glass-reinforced nylon using a second molding process. This highly simple process, coupled with choice of low-cost materials and simple but effective design, significantly reduces the cost of manufacturing the container as compared to prior art solutions.

These and other features of the invention will become apparent from the following description of the invention, taken in conjunction with the accompanying drawings.

DETAILED DESCRIPTION OF THE INVENTION

Figure 1:
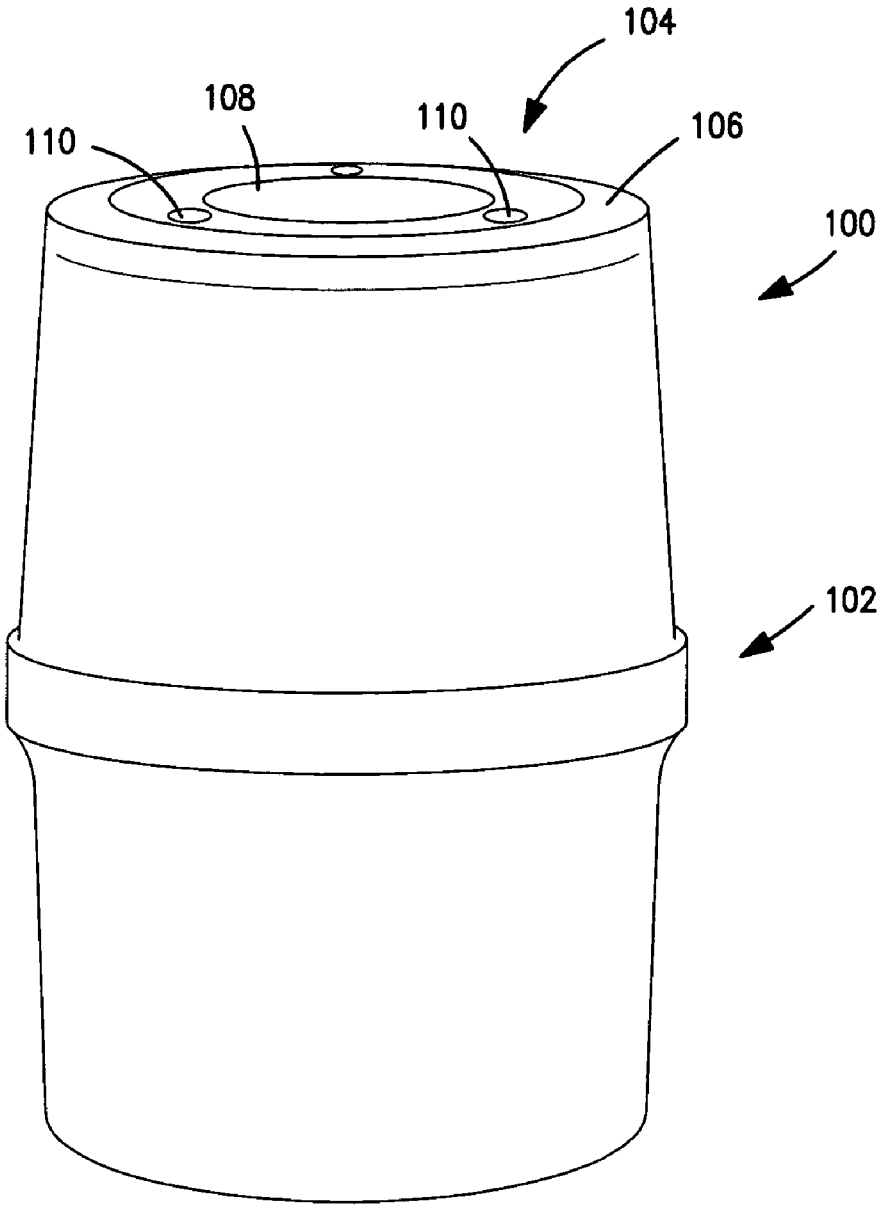
FIG. 1 is a perspective view of a first exemplary prior art animal exclusion container (Garcia Model 812).
Figure 2:
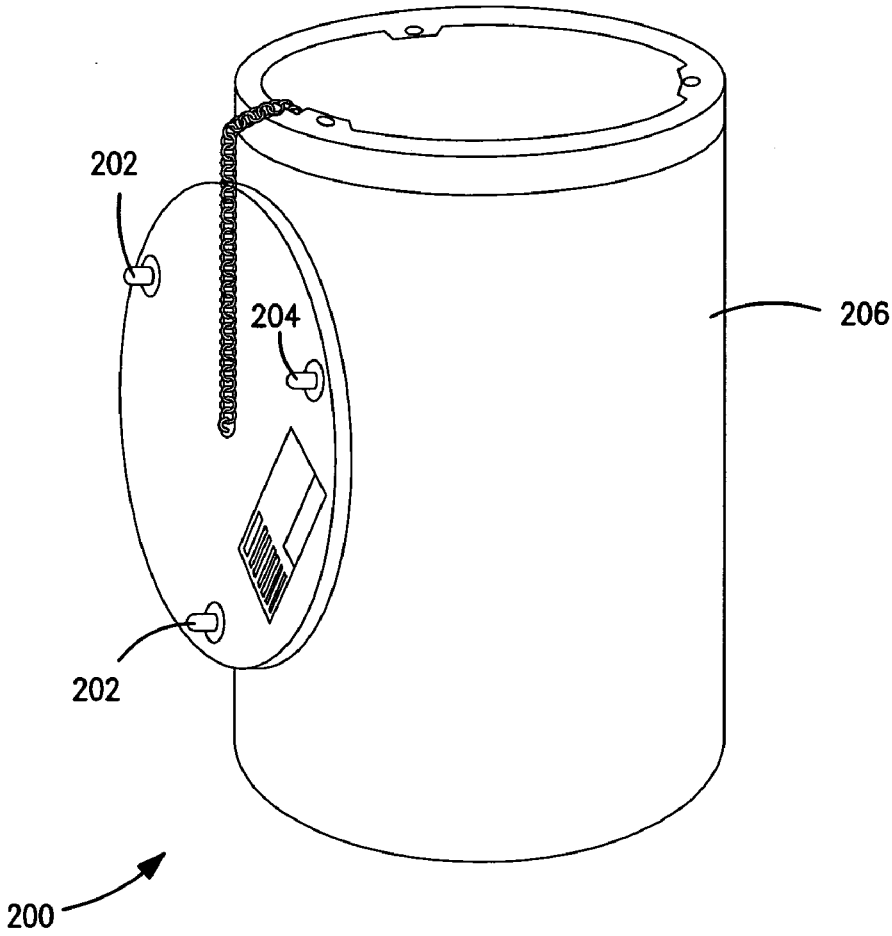
FIG. 2 is a perspective view of a second exemplary prior art animal exclusion container ("Bearikade").

Reference is now made to the drawings wherein like numerals refer to like parts throughout.

It is noted that while the invention is described herein primarily in terms of apparatus and methods for use with animal species such as bears, the invention may also be readily embodied or adapted to other species and applications. All such adaptations and alternate embodiments are readily implemented by those of ordinary skill in the relevant arts, and are considered to fall within the scope of the claims appended hereto.

As used herein, the term "animal" refers to any type of non-human living being or organism, including without limitation members of the *Ursa* or bear family (e.g., *ursus americanus* or black bear, *ursus horribilis* or grizzly bear, and *ursus maritimus* or polar bear), as well as other species.

As used herein, the term "molded" or "molding" refers generally to a process wherein a material is formed to a desired shape or configuration before curing or hardening. Molding may include for example, injection molding, blow molding, or transfer molding, or even other types of forming processes.

As used herein, the terms "exclusion" and "resistant" refer generally to the ability to frustrate access to a protected volume for a period of time.

Overview

The present invention comprises improved apparatus and methods for selectively permitting or restricting access to a container, such as is useful with various animal species including bears.

In one aspect, the invention comprises an improved container designed to provide all of the foregoing attributes (including light weight, low cost, ease of use and carrying, and climatic tolerance) while also presenting a virtually impenetrable barrier to animals. The exemplary embodiment comprises a highly resilient, lightweight, one piece polymer (polycarbonate) body or shell having a large-diameter aperture disposed at one end. A threaded, partially flexible lightweight polymer cap element mates with the body; the cap element comprises a tamper-resistant configuration with locking features which prevent rotation of the cap with respect to the body past a certain point. A ridge is formed on the body along the mating region of the cap, the ridge acting to prevent any animal (or human for that matter) from being able to insert anything (e.g., claws) under the cap when installed to pry it off. The locking features, ridge, body, and cap coordinate to make the cap sufficiently loose with respect to the body when installed so as to (i) absorb flexing of the body (such as under the weight of a bear standing on the side of the body), and (ii) permit passage of air between the interior and exterior of the body via the cap, yet preclude the cap from coming completely loose or exposing the underside of its outer rim to the animal. Hence, the exemplary container of the present invention is pliable enough to distort without opening, yet resilient and rugged enough to prevent permanent deformation, fracture, or cracking even under the weight (and motive forces) of a fully grown bear.

The container of the present invention is also advantageously equipped with features which permit ready carrying by the user via straps or other comparable means without slippage, thereby enhancing the container's functionality and the user's enjoyment.

Improved methods for manufacturing the aforementioned apparatus are also disclosed. These methods are greatly simplified over the prior art (especially those of the Model 812 and Bearikade devices previously described), thereby allowing the apparatus to be produced at extremely low cost.

Exemplary Embodiments

Figure 3:
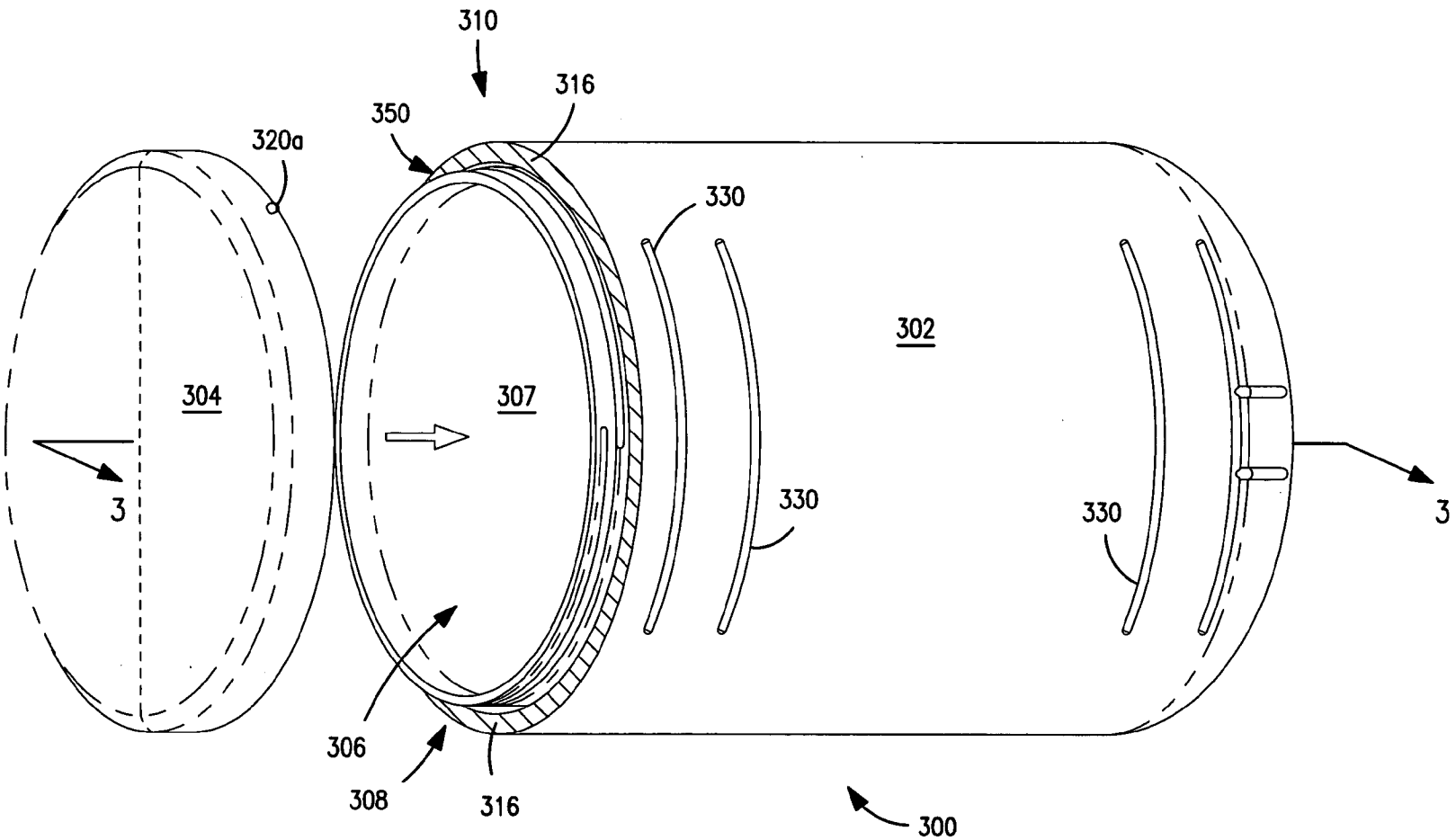
FIG. 3 is an exploded perspective view of a first exemplary embodiment of the tamper-resistant container apparatus according to the present invention.
Figure 3A:
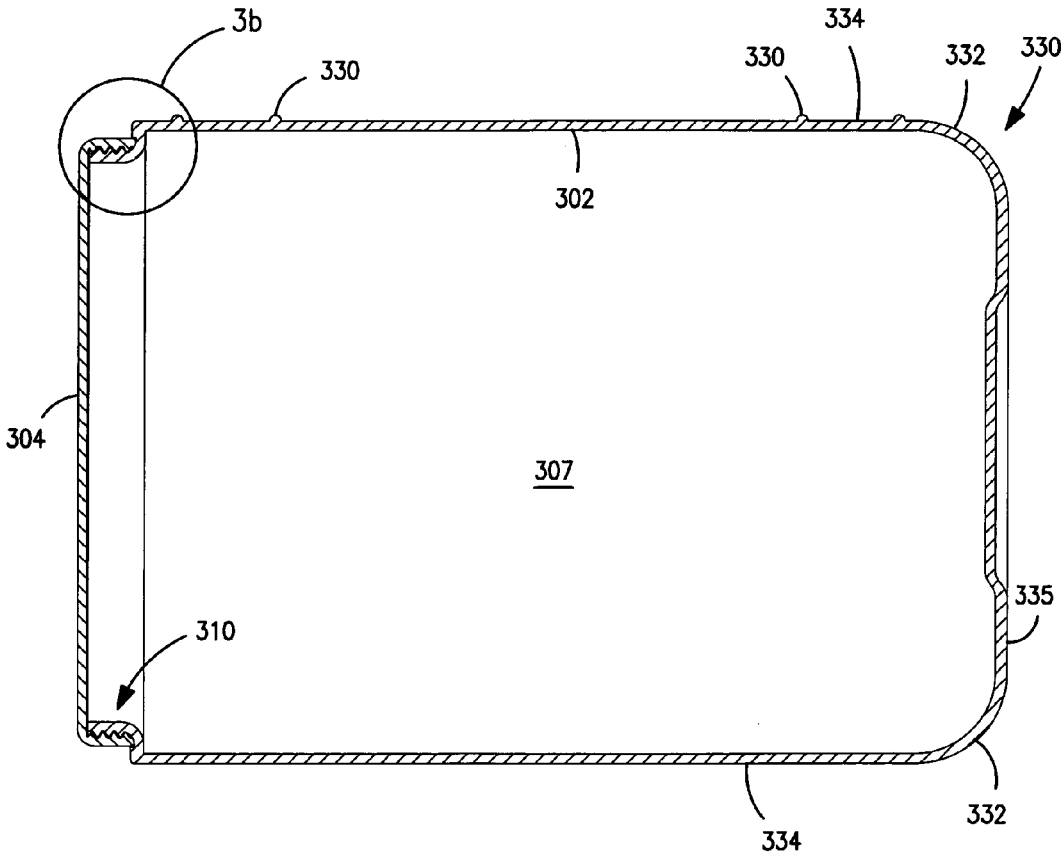
FIG. 3*a* is a cross-sectional view of the apparatus of FIG. 3 (when assembled), taken along line 3—3.
Figure 3B:
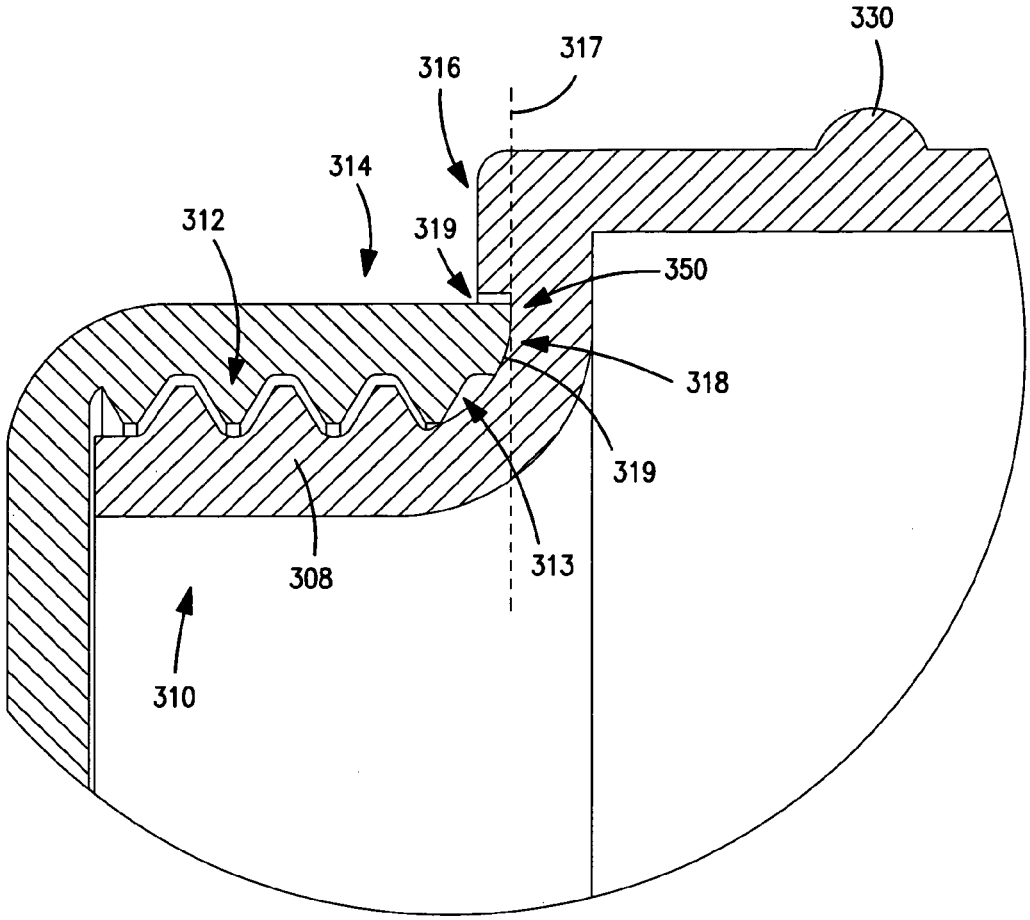
FIG. 3*b* is a partial (detail) cross-sectional view of the apparatus of FIG. 3, also taken along line 3—3, showing the cap and thread area.
Figure 3C:
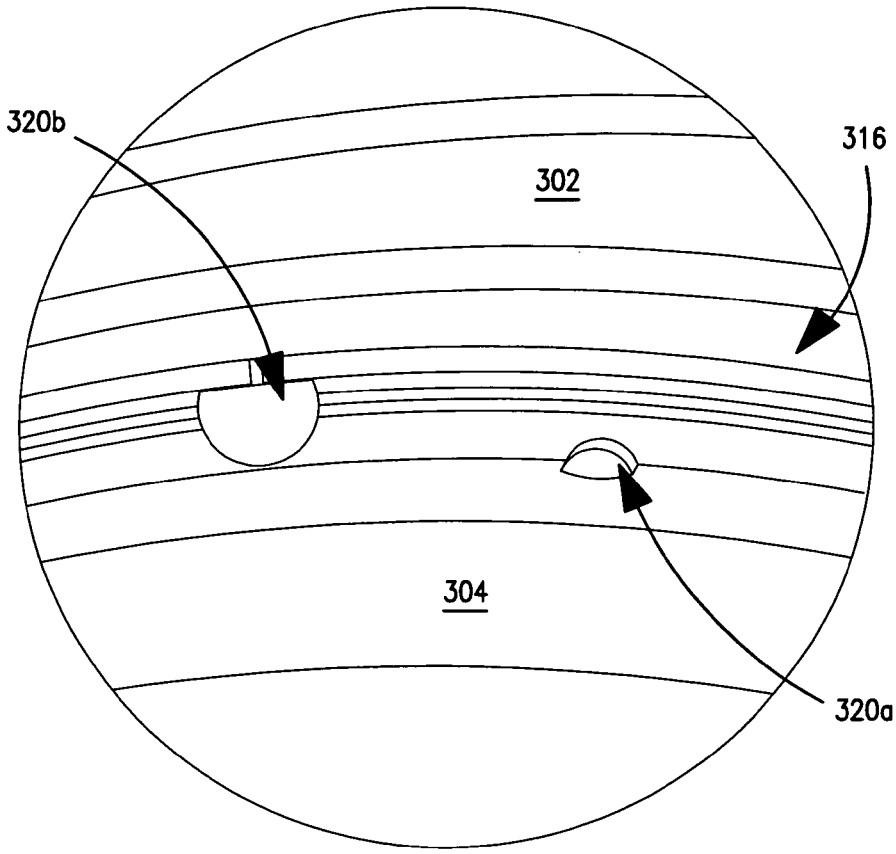
FIG. 3*c* is a top perspective view (partial) of the apparatus of FIG. 3, showing an exemplary locking element configuration.
Figure 3D:
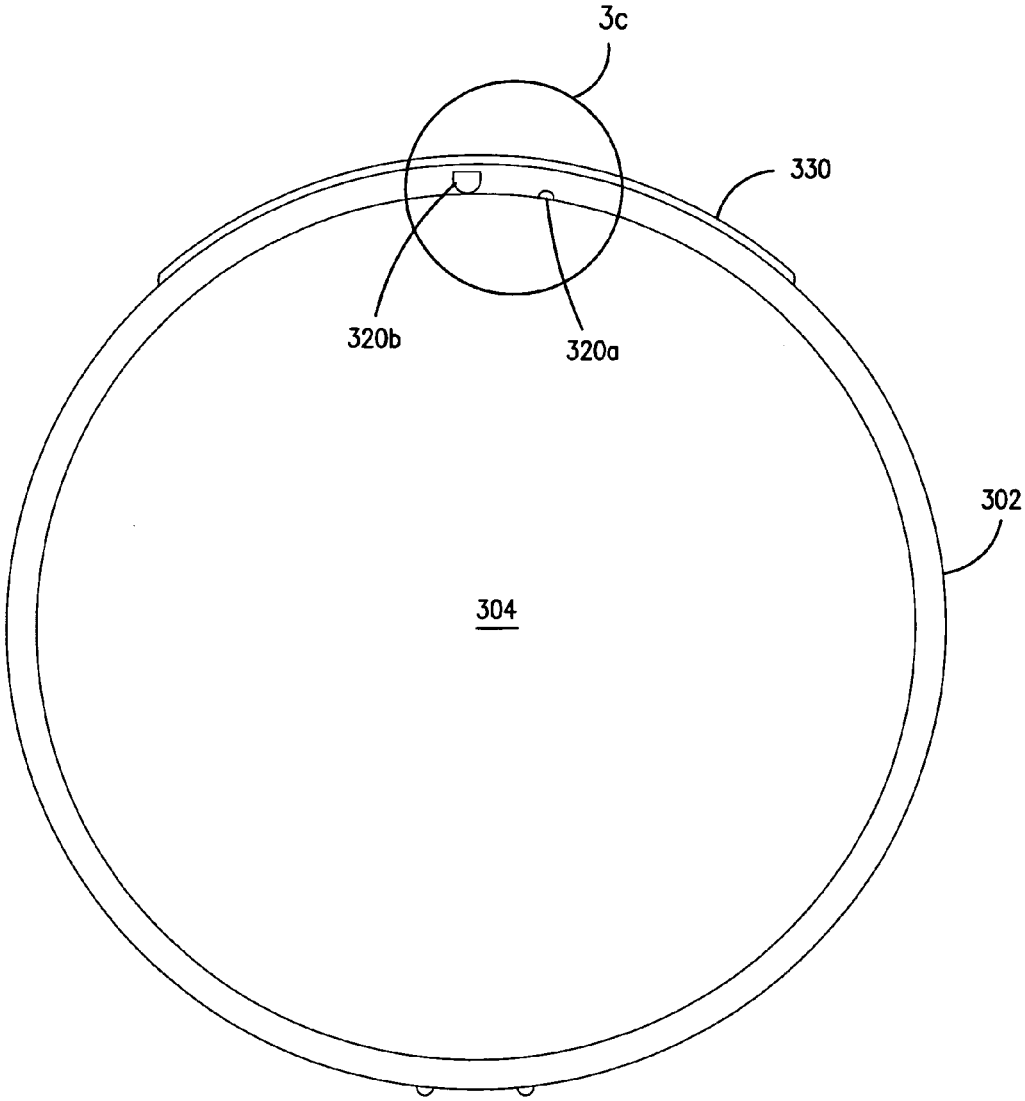
FIG. 3*d* is a front plan view of the apparatus of FIG. 3.

Referring now to FIGS. 3–3*c*, a first exemplary embodiment of the tamper-resistant container of the present invention is described in detail. It will be recognized that while these exemplary embodiments are designed primarily in the context of bear exclusion, the general attributes and principles may be particularly adapted to containers for use with other species, including even humans (e.g., small children).

Figure 3E:
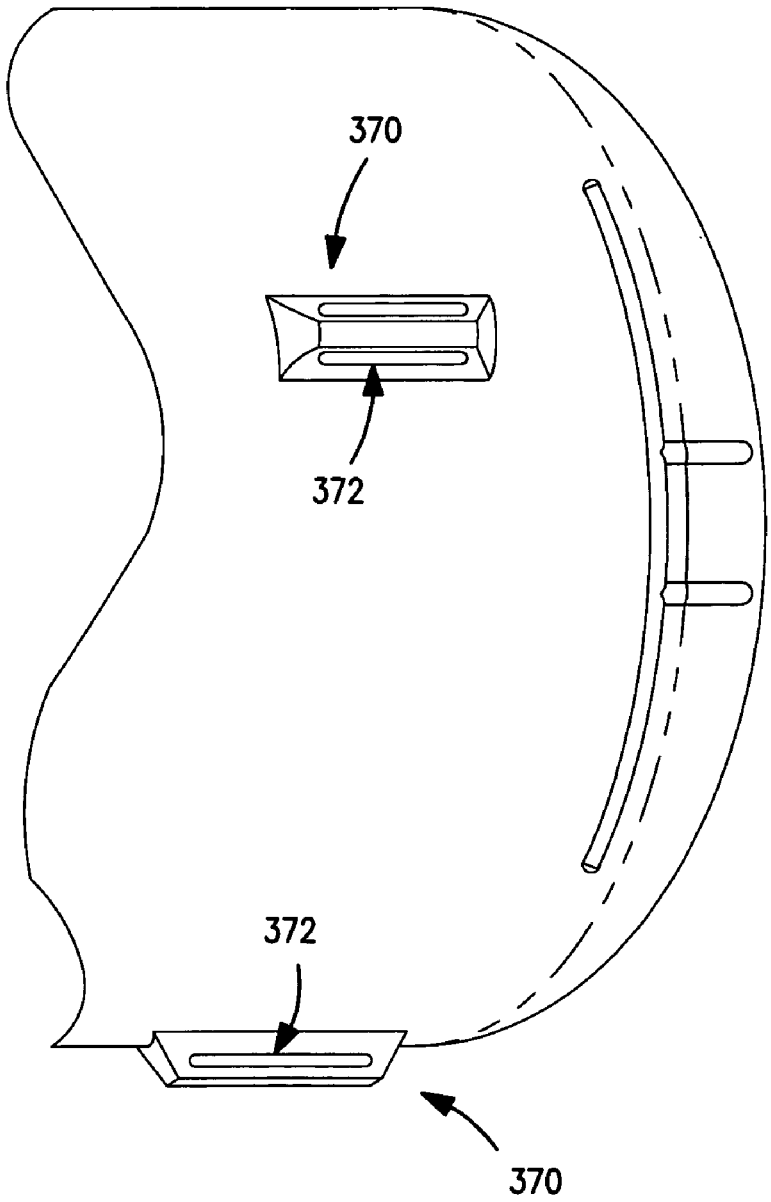
FIG. 3*e* is a partial perspective view of another embodiment of the container apparatus, illustrating an exemplary "loop" retention element configuration.

A first exemplary embodiment of the container apparatus 300 is shown in FIGS. 3–3*e*. As shown in FIG. 3, the first exemplary embodiment 300 comprises a substantially cylindrical body element 302 onto which a matching cap element 304 is mated. Specifically, the cap element 304 is threaded onto the body element 302 until the desired tightness is achieved. The body 302 is, in the illustrated embodiment, comprised of a substantially translucent molded polycarbonate polymer (having a bluish hue) nominally on the order of 0.13 in. thick, although other materials (even including lighter weight metals such as aluminum alloys) and thickness values may be substituted. It is also noted that the thickness may vary over the range of different locations on the body 302; for example, the illustrated body is approximately 0.16 in. thick on the bottom and 0.13 in. thick on the sides. The opacity and coloration of the body material are completely controllable using well known polymer techniques; hence, the body can be made to have literally any degree of opacity and any color (or mixture of colors, such as a camouflage pattern) desired.

Polycarbonate is chosen for the body material of the illustrated embodiment for, inter alia, its (i) low cost, (ii) relative abundance; (iii) great mechanical strength, including endurance under a high number of flexural cycles, high yield strength, good tensile and compressive strength, fracture/shatter and impact resistance, and hardness; (iv) flexibility, and (v) desirable resistance to everyday chemicals to which the body 302 may be exposed including, e.g., water, cleaning solutions, toothpaste, soft drinks (having carbonic acid), acetic acid, alcohols and solvents, and any number of other substances. The excellent mechanical properties of polycarbonate allows the body 302 of the illustrated embodiment to be substantially thinner than might otherwise be achieved through use of other materials (such as ABS), thereby allowing for lighter weight. Polycarbonates are well known in the polymer arts, and accordingly not described further herein.

The body 302 further comprises an aperture 306 formed in one end of the body, over which the cap 304 fits. The aperture is nearly the full diameter of the body 302 at the latter's widest point, thereby advantageously providing almost totally unimpeded ingress and egress from the interior volume 307 of the body 302 by the user.

The body 302 also includes a plurality of molded threads 308 (see FIG. 3*b*) formed along the outer periphery of the cap receiving portion 310 of the body 302. These threads 308 are matched in pitch and taper to corresponding threads 312 formed on the interior surface 313 of the ring portion 314 of the cap 304. The threads 308, 312 of the illustrated embodiment are disposed in "right hand" configuration such that tightening occurs when turning the cap relative to the body in a normal clockwise motion, although it will be appreciated that a counter-clockwise or reverse thread configuration may be utilized consistent with the invention, such as for making the apparatus more child-proof.

Also disposed proximate the threads 308 of the body 302 is a guard ridge 316 (see FIGS. 3*b* and 3*c*) which, in the illustrated embodiment, is molded into the body 302. This ridge is disposed proximate to the base plane 317 of the threads 308, and projects substantially upward (i.e., in a direction substantially parallel to the plane of the threads 308 and the cap receiving portion 310. This ridge 316 advantageously blocks access to the underside of the cap sidewall 318, since the bear (or other animal) cannot get its claws anywhere near the cap sidewall edge, when the cap 304 is installed on the body 302. The clearances and height of the exemplary ridge 316 are such that even if the cap 304 is not fully tightened, access to the cap-body gap 319 is completely frustrated. Hence, when assembled, the cap 304 and body 304 (and ridge 316) cooperate to form a substantially even, uniform outer surface with an extremely minimal, unexposed gap between the components. This cap/ridge relationship is also significant in light of the locking features 320, described in greater detail subsequently herein.

The thickness of the polycarbonate body molding varies somewhat over its area such that different portions as a whole are somewhat easier to flex than others. This is particularly true of the top portion of the body 302 near the threads 308, due in part to the presence of the aperture 306.

As shown in FIG. 3*a*, the bottom portion 330 of the body is formed with a highly rounded interface 332 between the side wall 334 and the bottom face 335 (the latter being indented by approximately 0.1 in. in the illustrated embodiment to present only an annular or toroidal contact area, to prevent the "pinchoff" region of the molding from interfering with the stability of the container, and to provide greater stability to the container 300 when placed on an uneven surface potentially having "clutter" such as small rocks and the like). The rounded interfaces 332 advantageously preclude the bear or other animal from getting its jaws solidly locked onto the container 300, or cracking this particular area of the body molding. It is noted that some larger bears may be able to get the entirety of the diameter of the body 302 within their jaws; however, testing performed by the inventor hereof on actual bears (zoo) has indicated that even large bears lack sufficient jaw strength to crack or collapse the high-strength polycarbonate body. The exemplary embodiment of FIG. 3 also avoids the use of any extended ridges or features (with the exception of the gap-protecting ridge 316) so as to frustrate attempts by the animal to catch its teeth on such features, thereby providing additional biting leverage. The hardness and relative smoothness of the polycarbonate molding also frustrate such attempts, since the animal's teeth cannot significantly penetrate the polycarbonate to any sufficient depth, and merely slide off.

The cap element 304 also comprises a one-piece molding; however, glass reinforced nylon is selected for this component so as to match the thermal expansion properties of the polycarbonate container to prevent the lid from seizing onto the container in cold weather and to provide sufficient strength, yet with very low weight and flexibility and chemical/substance resistance. It will be appreciated, however, that other types of material (including both other variants of nylon, and other polymers or mixtures thereof) may be substituted with equal success. The present embodiment utilizes a glass reinforced nylon molding of approximately 0.120 in. nominal thickness at its center to provide the desired mix of rigidity and flexibility (described in greater detail below); however, other thickness values may be used.

Locking features (elements) 320*a*, 320*b* are also provided on both the body 302 and cap 304 of the illustrated embodiment to effect animal exclusion, yet permit the user ready access in contrast to the more complicated, costly, and difficult to operate locking mechanisms of the prior art previously solutions described herein, the locking features 320 of the present invention are ultra-low cost, ultra-light weight, and require no tools or coins to operate. Specifically, the locking elements 320 comprise complementary raised bumps (here, substantially hemispherical shapes) disposed in relative opposition to each other, one on the cap element 304, one on the body element 302. In the illustrated embodiment, the locking elements 320 are each molded as part of their parent structure (i.e., cap 304 or body 302), although other arrangements including bonding via adhesives or the like may be substituted. The molding of the elements 320 into their parent structures reduces cost by obviating additional labor steps, and increases rigidity in that the elements 320 are integral with the molecular structure of the parent device.

The locking elements 320*a*, 320*b* (FIG. 3*c*) are disposed on the cap 304 and body 302 respectively at an elevation and position such that the two elements 320 engage one another when the cap 304 is partly screwed onto the body 302, with sufficient threaded engagement to preclude easy cap removal. Specifically, the locking elements 320 are designed to engage when the cap is approximately ⅔ through its full rotational travel, thereby placing the lower edge of the cap sidewall 318 well below the elevation of the body ridge 316. Hence, when the cap 304 is not fully screwed on, the inter-cap gap 319 is not exposed to the animal. When the two locking elements 320*a*, 320*b* do engage, the user simply distorts the cap sufficiently (and concurrently applies torque to the cap in the rotational direction) so as to cause the one element 320*a* to move past the other element 320*b*. This (albeit minimal) distortion is accomplished simply through grasping the cap in one's hands, the nylon material being sufficiently pliable to flex enough to move the two elements 320*a*, 320*b* relative to one another in the radial dimension, somewhat akin to the well-known "child-proof cap" on pharmaceutical bottles.

Herein lies a salient advantage of the present invention; i.e., that once the two locking elements 320 are past one another (i.e., the cap is tightened sufficiently such that the cap element 320*a* has proceeded beyond the body element 320*b*), the cap 304 can be left in this position, i.e., not completely tightened, and it is none-the-less fully animal-proof. This feature is accomplished through coordination of the locking elements 320 (and their placement), the cap 304, threads 308, 312, and the ridge 316. This functionality is particularly useful when making significant altitude changes; the user merely does not screw the cap down tight, which permits at least some passage of air over the threads, and prevents a significant differential pressure from building up and potentially creating a "vacuum" lock on the cap 304, thereby making it difficult to open. Small pressure equalization holes can also be provided if desired; however, these allow odors (e.g., food) resident within the container volume to interchange with the outside air, thereby potentially attracting animals and potentially inciting attack thereby if the user is carrying the container 300.

It will further be recognized that while the illustrated embodiment shows one pair of locking elements 320*a*, 320*b*, multiple sets may be used. For example, a first and second set could be disposed at slightly different azimuths along the periphery of the body upper portion 310 and cap 304, such that multiple manipulations and distortions are required to install or remove the cap 304. This would also potentially act as insurance against the bear getting "lucky" and potentially exerting the right combination of forces and motion to rotate the cap 304 past the first set of locking elements 320; the bear would in fact have to get lucky twice (or more times when added sets of locking elements are used) to get the cap off the container body.

Alternatively, two sets of locking elements can be disposed diametrically opposed to one another (i.e., pi radians away from each other), such that a doubling of the force normally necessary to overcome the interference between one set of elements 320 is achieved. Myriad other variations along the foregoing themes are possible consistent with the invention, as will be appreciated by those of ordinary skill in the mechanical arts.

In use, the locking features 320, ridge 316, body 302, and cap 304 coordinate to make the cap element 304 sufficiently pliable with respect to the body 302 when installed so as to (i) absorb flexing of the body (such as under the weight of a bear standing on the side of the body), and (ii) permit passage of air between the interior and exterior of the body via the cap, yet preclude the cap 304 from coming completely loose or exposing the underside of its outer rim to the animal. Hence, the exemplary container of the present invention is advantageously flexible enough to distort without opening, yet resilient and rugged enough to prevent permanent deformation, fracture, or cracking. The polycarbonate body 302 and Glass reinforced nylon cap 304 coordinate to absorb and dissipate the mechanical force applied by the animal through controlled flexing of these components, thereby rendering the container highly resistant to both slowly applied forces and more impulsive transients.

It is significant to note that, in contrast to the prior art (such as the Model 812 device), the cap 304 of the present embodiment does not form a significant compressive structural member for the body 302. As previously described, the Model 812 device uses the relative incompressibility of the cover plate in the transverse direction to bolster the canister body in the region of the access aperture. Hence, the cover of the Model 812 is placed under compressive loading when transverse loads are applied to the canister body. Contrast this with the embodiment of FIG. 3, wherein the cap 304 in no way is exposed to compressive load (and actually may be exposed to some tension loading) when the body 302 is compressed transversely.

The foregoing cap/ridge/body arrangement also advantageously helps prevent moisture intrusion within the container volume; the small gap 319, ridge 316, and threads 308, 312 coordinate to make the container 300 highly moisture resistant, even when the container is submerged in moderate depths of water (assuming the cap 302 is tightened down). The outside pressure of the water during submergence also helps to seal the cap against the inner radial portion 350 of the body 302 (i.e., the annulus directly behind the ridge 316), as well as other portions of the body, thereby effectively mitigating further water intrusion.

The foregoing cap/ridge/body arrangement also advantageously prevents the intrusion of rain or other incidental moisture into the container (regardless of container attitude) due to the overlapping nature of the lid and threads, a feature which the prior art Model 812 fails to provide.

As shown best in FIG. 3, the body 302 also optionally contains a plurality of retention elements 330 disposed on the outer surface of the body 302. In the illustrated embodiment, these elements 330 comprise a plurality molded-in "ridges" of approximately 0.064 in height disposed in two parallel rows extending around at least a portion of the circumference of the outer surface of the body sidewall. These rows are offset by a given amount from each other (nominally 1.28 in.) corresponding roughly to the width of a standard restraining strap. Two sets of rows are provided; a first 333 near one end of the body 302, a second 334 near the other (cap) end of the body. In operation, these elements 330 act to prevent restraining straps affixed by the user and disposed between the rows (of each set) from moving of sliding longitudinally along the body 302 during user movement. The present embodiment uses rounded-cross-section ridges (versus other shapes) to both provide good restraint and minimize the opportunities for the animal catching its teeth on the elements and potentially gaining additional leverage as previously discussed (i.e., maintaining a smooth and largely featureless outer presentation). However, such rounded cross-section is not an essential feature, since the polycarbonate body 302 is sufficiently robust to withstand biting pressure even if the animal can get a firm bite on the body via any surface features. While ridges are shown, it will be appreciated that many other configurations of these retention elements 330 may be used in substitution or in concert, including e.g., a series of raised bumps, punctuated set of ridges, rough texture patches, molded-in channels or depressed regions, and the like.

In another embodiment (FIG. 3*e*), the retention elements 370 comprise two or more molded "loops" having an aperture 372 formed therein for receiving a restraining strap (not shown). These loops have the advantage of more securely capturing the restraining strap(s), and also frustrating uncontrolled rolling of the cylindrical container 300 down an incline (the loops 370 act as rotation stops). However, the loops 370 also present a better opportunity for the animal to latch its teeth or claws onto the container. Yet, even if exposed to force sufficient to fracture the loop 370, the properties of the polycarbonate and design are such that the loop only will fracture, and not cause any significant damage to the body 302 of the container. This feature maintains the structural integrity of the container while providing the benefits (i.e., better restraint and anti-roll protection) previously described.

The container 300 of FIG. 3 may also be textured on its surfaces if desired. For example, in one exemplary variant (not shown), a semi-rough surface texture is applied over a substantial portion of the outer surfaces of the body 302 (such as by using an acid-etch process of the type well known in the polymer molding arts on the mold used to make the body), thereby providing reduced slippage in the hands of the user, as well as some degree of opacity. External texturing may also reduce the ease with which the aesthetics of the container 300 are degraded, such as by making it more scratch resistant (or at least making any scratches or damage that does occur less noticeable).

Similarly, if it is desired to keep the outer surfaces smooth (to mitigate animal tooth or claw friction), the texture can be applied to the interior surfaces of the body. One potential benefit of such texturing is the reduced visual feedback provided to the offending animal; a bear which sees an apple in the container 300 is probably more likely to persist in its efforts as compared to one which does not. Similarly, other types of coatings can be applied to the inner and/or outer surfaces of the container body 302, such as for example a mirrored or white reflective coating to mitigate solar or radiant heating of the contents of the container. Such coatings may comprise for example the functional equivalent of shelf paper, which is low cost, low weight, adherent to the relevant surface, or even be entrained within the polymer body itself in the form of inclusions, etc.

The benefits of the container 300 of FIG. 3 can also be quantified in terms of commonly used metrics; i.e., capacity and weight. Capacity is typically measured in person-days of supplies. Weight is measured in any appropriate unit (e.g., pounds or kg). Hence, one can form a useful measure of the spatial efficiency of a container by ratioing these two quantities; i.e., capacity/weight. A higher weight and lower capacity device will produce a lower spatial efficiency index (SEI). The inventor hereof has measured the most commercially popular prior art solution (Model 812), and found it to have a weight of 2 lbs., 12 oz. (approximately 1250 grams, or 1.25 kg). It is advertised as having a 6-person day capacity. Hence, the SEI for this device is 6/1.25=4.80. In contrast, the exemplary embodiment of FIG. 3 (manufactured by the inventor hereof as of the date of this filing) has an SEI of 7/1.11=6.31. The present invention therefore provides clearly improved storage capacity per unit of container weight (approximately a 31% improvement on the basis of the SEI metric) over the Model 812 device.

When considering the smallest Bearikade model (6-person days at 1 lb, 15 oz.), the SEI of the Bearikade is higher than that of the exemplary embodiment analyzed above (i.e., 6.82 versus 6.31, the former roughly 8% higher). However, similar metrics must also be applied in terms of cost; e.g., cost per unit of capacity, etc. Owing to its lower manufacturing cost, the present invention compares very favorably to both of the prior art solutions described above when cost as well as SEI is considered. The referenced Bearikade model costs more than twice that of the exemplary embodiment of the present invention, with only 8% better SEI, while the Model 812 device has both higher cost and lower SEI.

Figure 4:
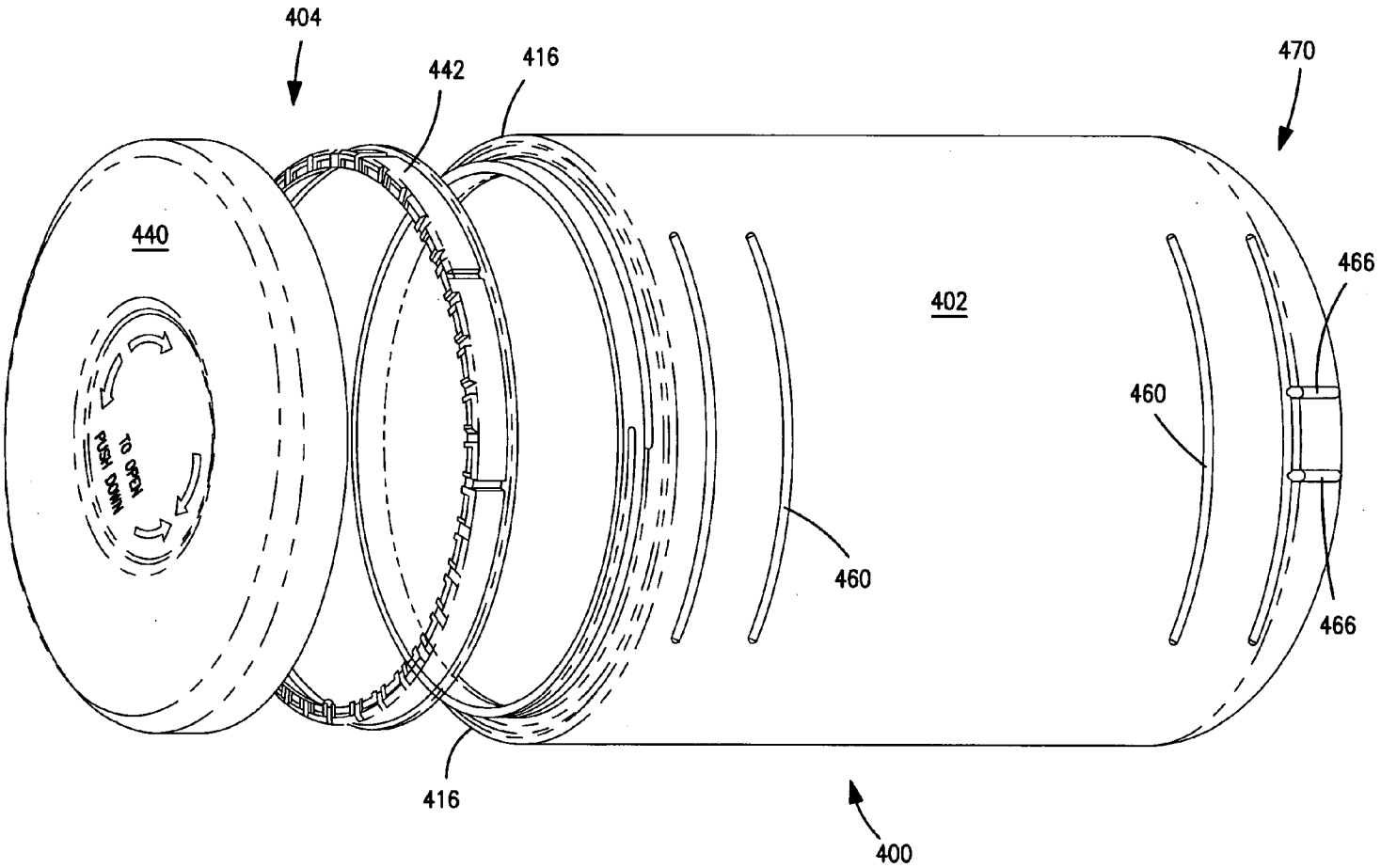
FIG. 4 is perspective view of a second exemplary embodiment of the tamper-resistant container apparatus according to the present invention, including two-piece cap assembly.
Figure 4A:
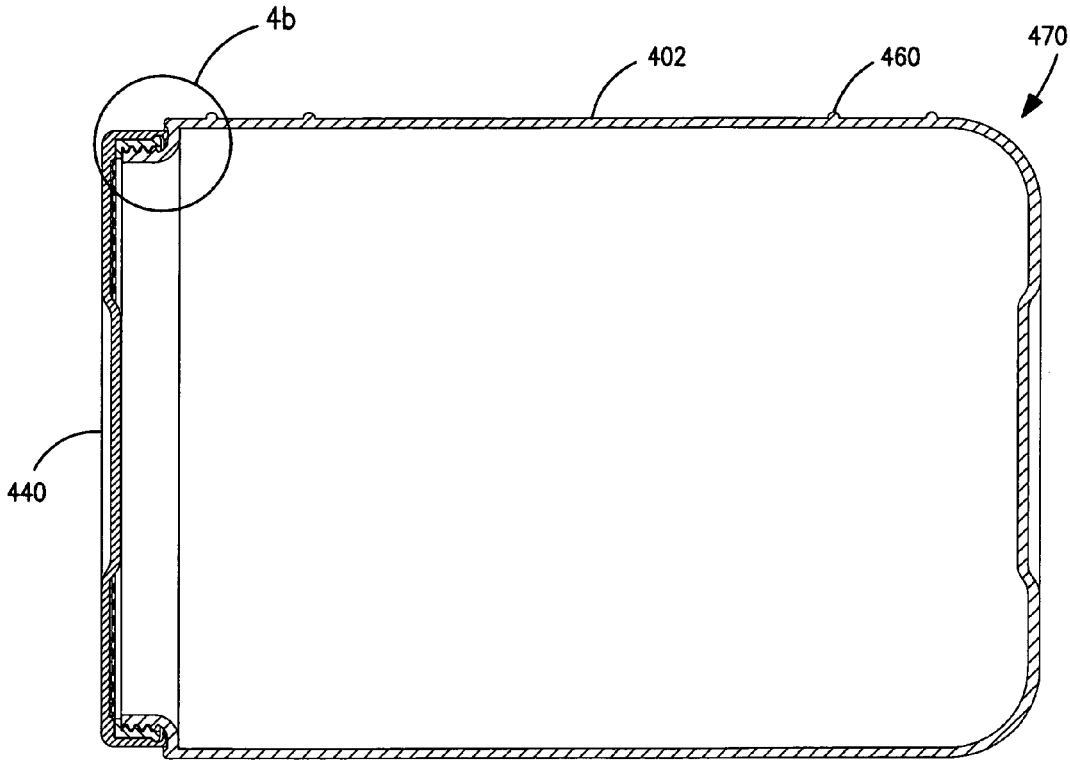
FIG. 4*a* is a cross-sectional view of the apparatus of FIG. 4 (when assembled), taken along line 4—4.
Figure 4B:
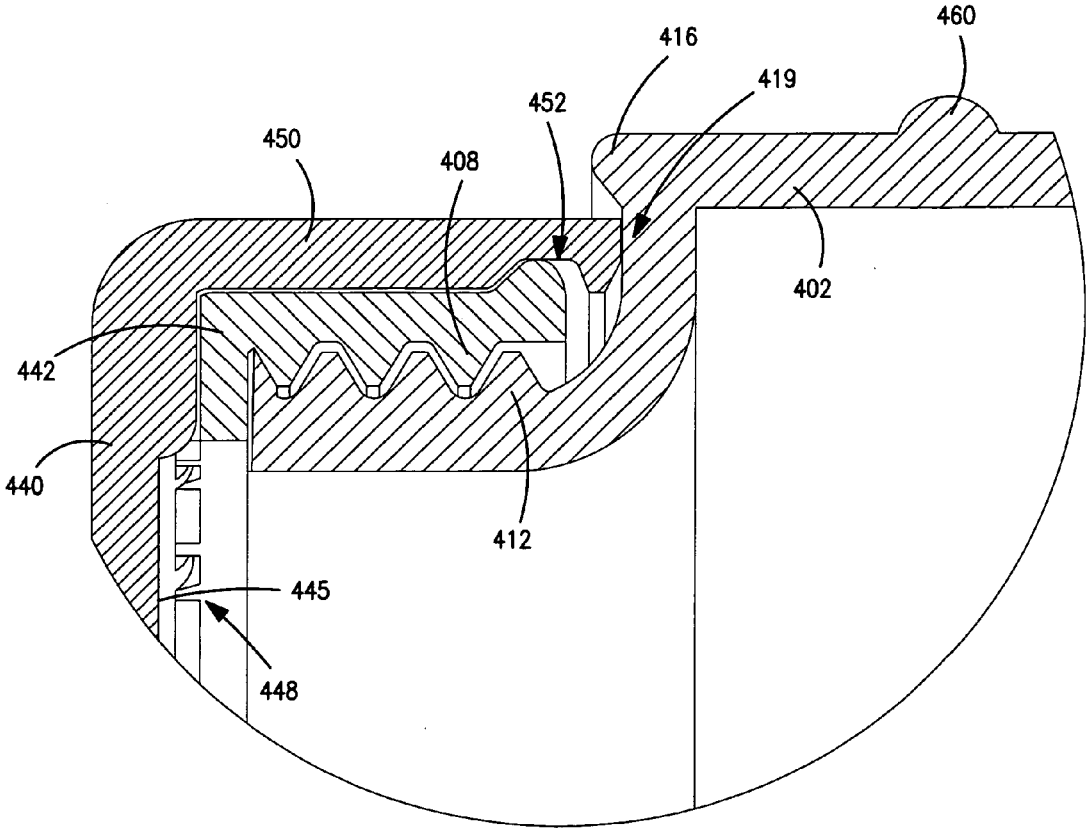
FIG. 4*b* is a partial (detail) cross-sectional view of the apparatus of FIG. 4, also taken along line 4—4, showing the cap assembly and thread area.
Figure 4C:
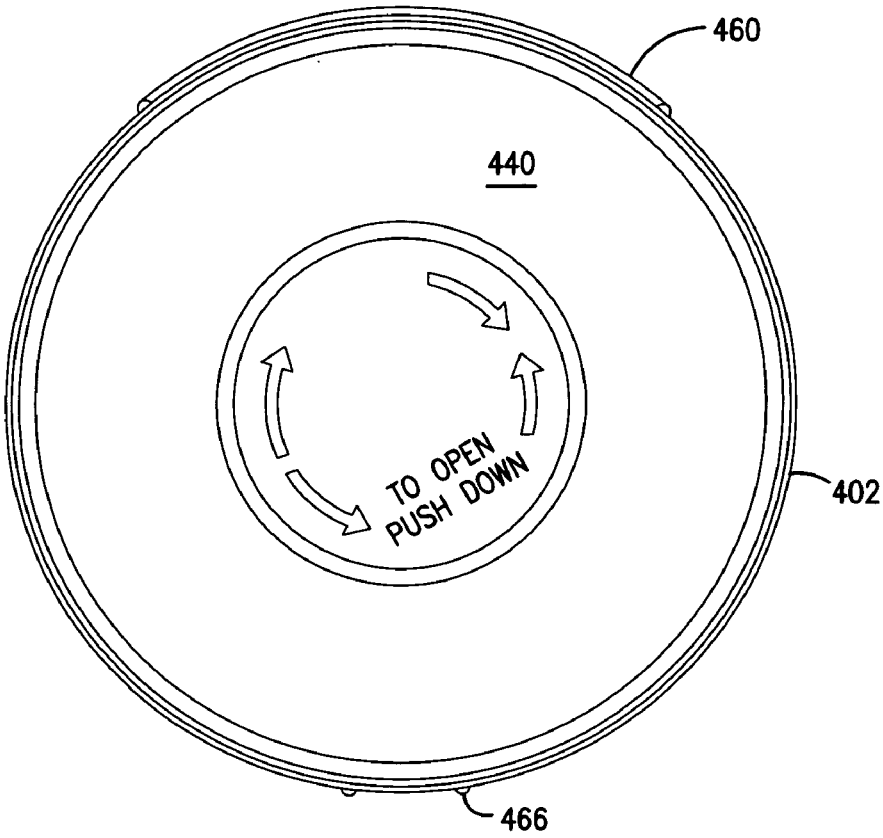
FIG. 4*c* is a front plan view of the apparatus of FIG. 4.
Figure 4E:
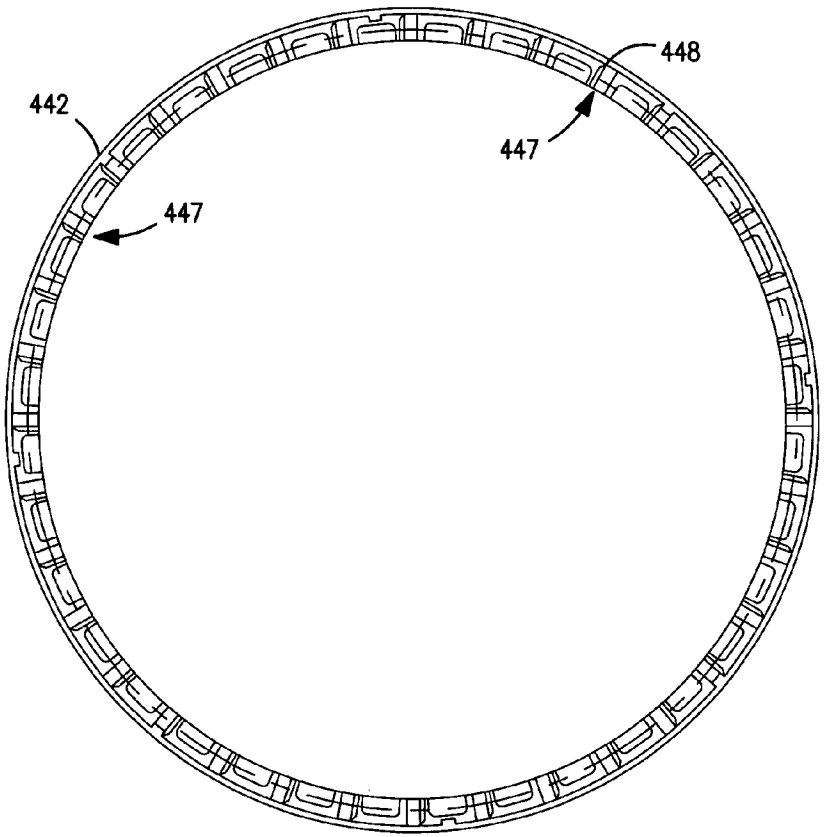
FIG. 4*e* is a top plan view of the ring structure of FIG. 4*d*.
Figure 4D:
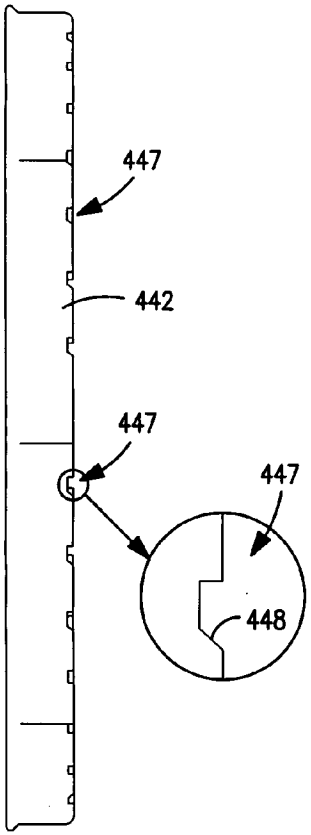
FIG. 4*d* is a side plan view of an exemplary embodiment of the cap assembly ring structure of the embodiment of FIG. 4
Figure 4F:
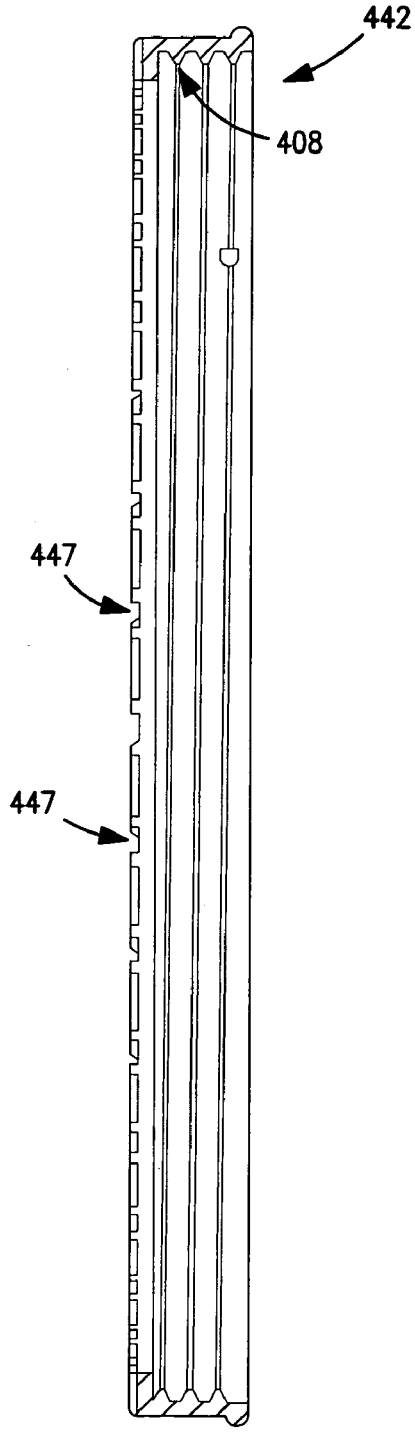
FIG. 4*f* is a partial side cross-sectional view of the ring structure of FIG. 4*d*, showing interior threads.
Figure 4G:
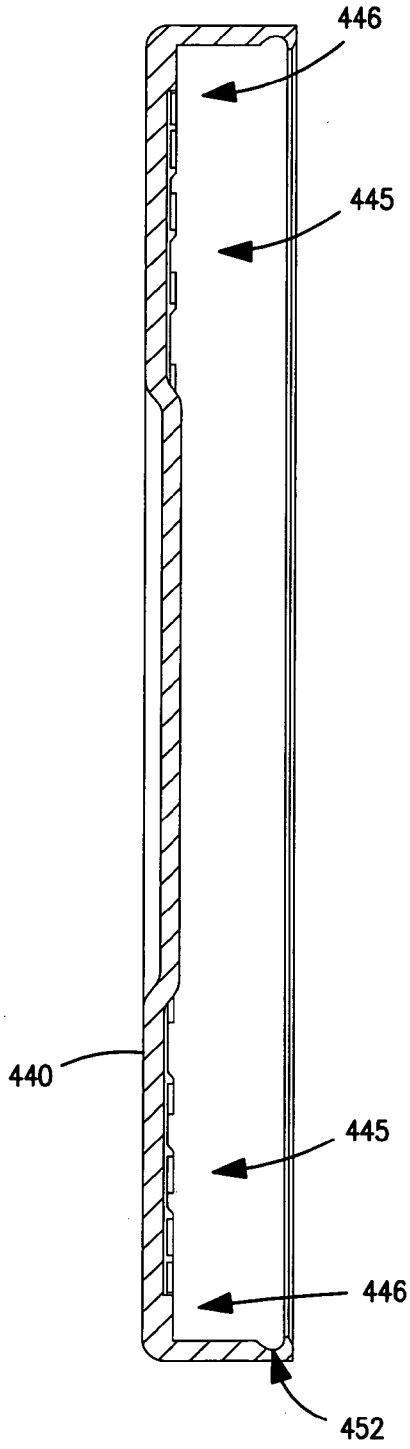
FIG. 4*g* is a side cross-sectional view of the exemplary cap element of the embodiment of FIG. 4, taken along line 4—4.
Figure 4H:
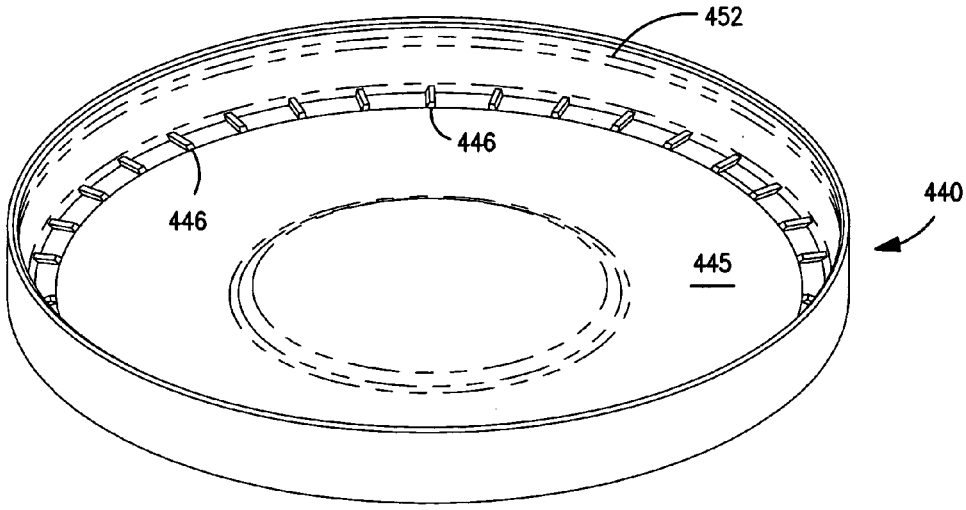
FIG. 4*h* is a perspective view of the cap element of the embodiment of FIG. 4, showing the interior region.
Figure 4I:
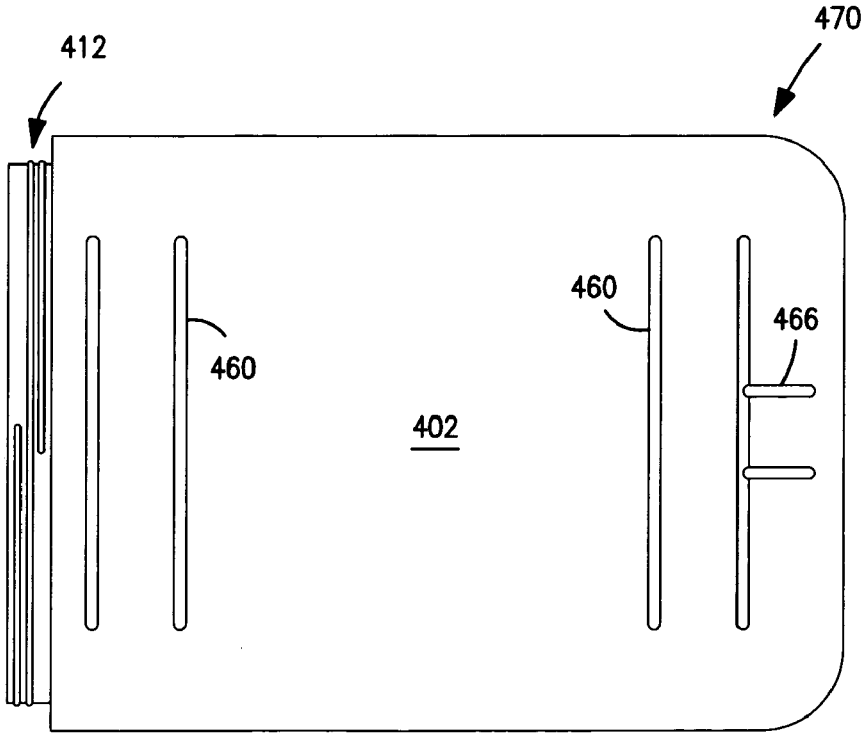
FIG. 4*i* is a side elevation view of the container apparatus body of FIG. 4, showing the retention and anti-rotation elements.

Referring now to FIGS. 4–4*i*, a second exemplary embodiment of the container apparatus is described. In this embodiment, the apparatus 400 comprises a body 402 and cap 404 generally similar to that of FIG. 3; yet the cap 404 comprises a two-piece assembly adapted to provide a safety or exclusion function. Specifically, the illustrated cap 404 includes an outer cap element 440 and a corresponding interior ring structure 442, the two components 440, 442 cooperating permit substantially unimpeded rotation of the cap element 440 with respect to the ring unless a downward (normal) force is applied. Hence, the cap assembly 404 functions much like a child safety top on a pharmaceutical bottle. FIGS. 4*b* and 4*d*–4*h* illustrate the details of these components 440, 442. As shown in the Figures, the ring structure 442 is adapted to fit within the interior portion of the cap element 440, and slide selectively therein. The interior surface 445 of the cap element 440 (FIGS. 4*g*–4*h*) includes a plurality of raised features 446 which project normally from the surface 445. The height of these features 446 is controlled such that there is just enough friction between them and corresponding ones of groove elements 447 (FIGS. 4*d*–4*f*) formed in the top surface of the ring structure 442. While the raised features 446 are substantially symmetric, the groove elements 447 are purposely made asymmetric (i.e., one edge 448 of each groove 447 is tapered from vertical so as to frustrate meaningful frictional contact with a corresponding edge of a raised element 446 of the cap 440. Hence, the cap element 440 and ring structure 442 are polarized in one direction; rotation of the cap element 440 relative to the ring structure 442 (and hence the container body 402) in a clockwise direction allows two substantially vertical edges (one on the raised element 446, one on the corresponding groove element 447) to positively engage, thereby allowing the user to tighten the cap assembly 404 onto the body 402. Each pair of raised elements 446 and groove elements 447 also engages in similar manner.

However, when rotating the cap element 440 in the counter-clockwise direction (loosen direction for right-hand threads), the aforementioned tapered edge of each groove element engages a corresponding (substantially vertical) edge of each raised element 446, with the result that the two components 440, 442 do not positively lock together and slide in relation to one another unless an appreciable downward force (on the order of 10 pounds or 10 lbf) is applied to the cap element 440 during rotation. This downward force allows sufficient frictional coupling between the two elements 446, 447 (and others along the periphery of the cap/ring structure) to overcome the frictional counter force generated by the mating of the two sets of threads 408, 412 on the inner surface of the ring structure 442 and the outer surface of the body 402, respectively. If insufficient downward force is applied, the two components 440, 442 slip, and the ring structure 442 remains unmoved while the cap element 440 merely rotates over it.

The cap element 440 is retained relative to the ring structure 442 by way of a lip or recess 452 formed on the interior surface of the cap element vertical sidewall 450, as shown best in FIGS. 4*b*, 4*g* and 4*h*. Since the polycarbonate body 402 is substantially rigid, and the ring structure 442 tightly engages the thread portion of the body 402, the ring structure is very firmly supported against inward deflection. Similarly, since the ring structure is received within the recess 452 of the cap element 440, the latter being resistant to outward deflection or spreading, the ring structure 442 is also firmly supported against outward deflection or disengagement of the threads 408, 412. Hence, the recess 452 is sufficient to keep the ring structure 442 firmly captured within the cap element 440 under all operational conditions and loadings. This is especially true when considering the presence of the ridge 416 formed on the body 402 proximate to the bottom edge of the cap element 440; specifically, the animal can exert no significant shear or upward force on the cap element (so as to separate the cap element 440 from the ring structure 442 and body 402), since it cannot get any portion of its claws or teeth into the gap 419. The cap element 440 is also made quite low in vertical profile (less than one inch), thereby affording the animal very little of a comparatively slick surface to grasp onto.

The embodiment of FIG. 4 utilizes a Glass reinforced nylon cap element 440 similar to that of the embodiment of FIG. 3; however, the ring structure 442 is formed (molded) of a low-friction polypropylene polymer of the type well known in the art. This latter material is chosen for low cost and good mechanical properties including sufficient strength and low friction. It will be appreciated, however, that other materials (polymer or otherwise) may conceivably be substituted. For example, fluorinated polymers such as ethylene tetra-fluoroethylene or ETFE (Tefzel®) or Teflon ® may be used, such fluoropolymers having excellent friction resistance and chemical/mechanical properties (albeit at somewhat higher typical cost than glass reinforced nylon or comparable materials). Similarly, the ring structure 442 can be made from Glass reinforced nylon. Myriad other options are available.

It will also be appreciated that the foregoing locking mechanisms (i.e., the locking elements 320 of the embodiment of FIG. 3, and the "safety cap" mechanism of the embodiment of FIG. 4) can be combined if desired, in order to provide an extra level of protection. For example, the locking elements 320 of FIG. 3 can be utilized as a secondary lock or backup to the safety cap of FIG. 4, the former being positioned such that after the thread friction of the ring structure 442 is overcome, the user must then distort of deflect the cap element 440 such that the two locking elements 320 can slide past one another as previously described with reference to FIG. 3.

As shown in FIG. 4*i*, the illustrated embodiment also includes a plurality of retention ridges 460 having generally similar functionality to the retention elements 330 of the embodiment of FIG. 3. A set of complementary anti-rotation features 466 are also disposed proximate to the base 470 of the body 402. In the illustrated embodiment, these anti-rotation features 466 comprise ridges which are vertically oriented or substantially parallel to the longitudinal axis of the container 400. These features 466 are utilized to, inter alia, provide friction to a user attempting to hold the body 402 steady while rotating the cap. Specifically, the user straddles the container 400 and places the features 466 (one set each disposed diametrically opposed to the other proximate the base 470) in contact with the interior surfaces of their shoes/boots; the features 466 engage the user's shoes/boots and mitigate rotation of the body while screwing or unscrewing the cap assembly 404. While ridges are shown, it will be appreciated that many other configurations of these features 466 may be used in substitution or in concert, including e.g., a series of raised bumps, rough texture patches, and flattened regions formed in the base area 470 or projecting out underneath the container.

It will be recognized that while two exemplary embodiments of locking mechanisms and cap structures have been described explicitly herein (i.e., those of FIGS. 3 and 4), numerous other cap/locking mechanism configurations can be used consistent with the invention to provide similar benefits and functionality. For example, the container cap may be configured such that the user must depress one or more tabs disposed on the periphery of the cap (not shown) in a radial direction (i.e., inward or outward) to permit the engagement of the cap to the ring structure. As yet another alternative, the cap/body may be configured such that combinations of motions (e.g., downward force and radial pressure) are required. All such variations will be readily recognized by those of ordinary skill provided the present disclosure, and are considered to fall within the scope of the claims appended hereto.

Another feature afforded by the low cost of the container apparatus described herein relates to its disposability; while a camper or hiker may think twice about letting a bear steal away with a higher cost container (e.g., graphite epoxy Bearikade), the cost penalty provided by loss of the container of the present invention is quite low. Hence, the present apparatus provides the user with added safety and freedom, in that loss of the apparatus is financially inconsequential, and the user will not be tempted to undertake ill-advised attempts at recovering the container (perhaps to their own detriment or that of the bear).

Method of Manufacturing

Figure 5:
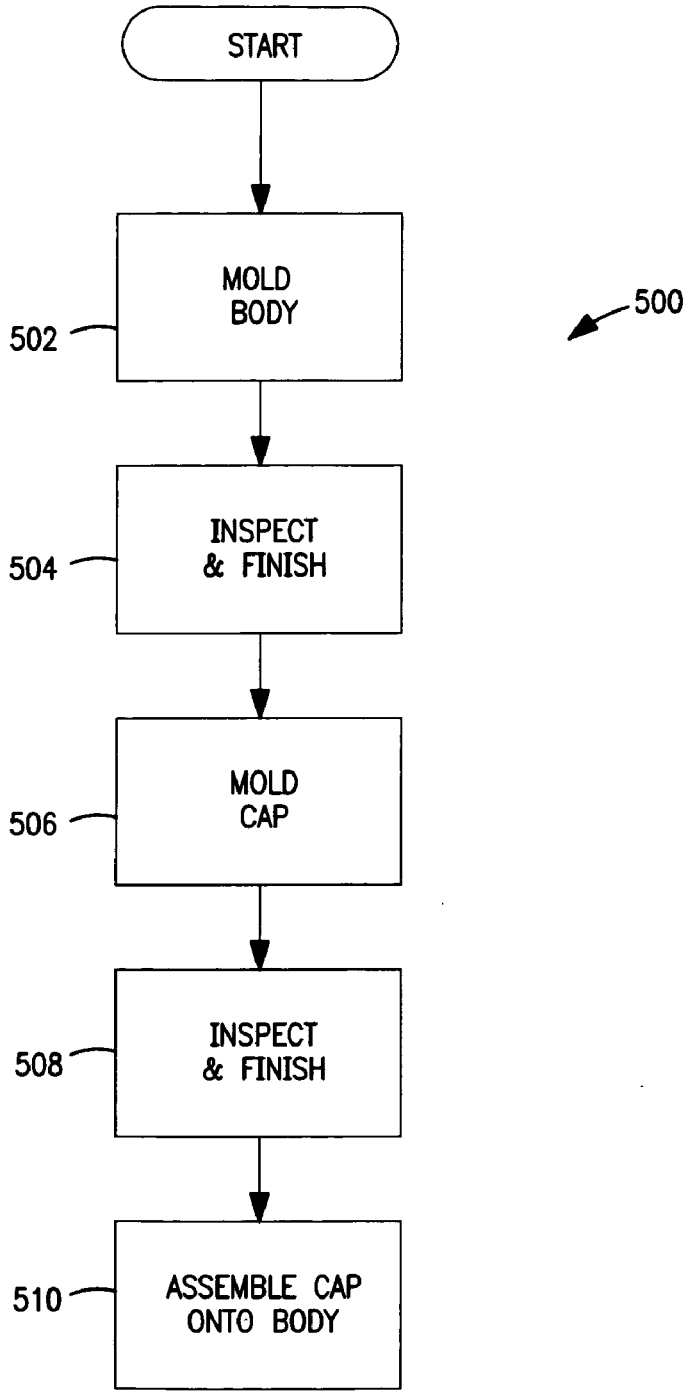
FIG. 5 is a logical flow diagram illustrating an exemplary embodiment of the generalized method of manufacturing the container apparatus of the invention.

Referring now to FIG. 5, an exemplary embodiment of the method of manufacturing the container apparatus is disclosed. It will be appreciated that while the following embodiment is described in terms of the apparatus 300 of FIG. 3, the methods may be readily adapted to any of the variants or embodiments disclosed herein, such adaptations being readily implemented by those of ordinary skill.

As shown in FIG. 5, the method 500 generally comprises forming the body 302 of the container using a molding process (step 502). As previously described, such molding process may comprise injection, blow, or transfer molding, although blow molding is selected in the illustrated embodiment based on, inter alia, its simplicity and low per-unit cost. Texturing may also be applied during or after the molding process if desired, as previously described herein.

The molded body is then inspected and finished (including removing any molding flash, and cutting off the blow dome at the end where the opening to the container is located) as necessary per step 504.

Next, the nylon glass-reinforced cap 304 is formed by a molding process (injection molding) per step 506, and similar finishing to that of the body 302 performed (step 508).

Lastly, the cap 304 is installed (threaded) onto the body 302 for final assembly (step 510).

While seemingly simple, the foregoing method 500 underscores a salient advantage of the present invention; i.e., its ultra-low cost to manufacture, owing in large part to (i) simplicity of design and (ii) selection of well understood and readily available materials and fabrication techniques. Use of more exotic composites and alloy components (such as in the prior art Bearikade) and ABS sections which must be bonded together (as in the Model 812) invariably necessitate higher manufacturing costs, and hence higher costs to the end user. Similarly, the use of inserted fasteners (such as in the prior art Bearikade and Model 812) adds complexity and costs to the end user. Polycarbonate technology is ubiquitous, being used for example in larger volume commercial water bottles. Design features such as the aforementioned exclusion ridge 316 also obviate the need for additional components and mechanisms.

Hence, the carefully considered design of components and selection of materials in the present invention are inherently part of what is otherwise a comparatively simple manufacturing process 500. It is significant to note that this simplified process would not be possible under the prior art, however, since all prior art designs necessitate additional manufacturing steps in relation to the process disclosed herein. Hence, the exemplary process 500 described above is just as significant for what is does not perform as what it does.

It can be appreciated that while certain aspects of the invention have been described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. Bear excluding apparatus, comprising:

a body having an interior volume and an aperture formed therein, said aperture having a diameter nearly the full diameter of the body;

a threaded cap having at least one locking element associated therewith;

wherein said cap threads onto or off said body by the action of a human; and a ridge formed proximate said cap, said ridge having a diameter larger than an outside diameter of said cap and having a region extending upward beyond a lower edge of said cap when said cap is fully threaded onto said body;

wherein said body, ridge and cap cooperate to exclude said bear from said interior volume.

2. The apparatus of claim 1, wherein said cap comprises a lower edge, said lower edge mating substantially flush with a corresponding surface of said body so as to substantially eliminate any gap there between.

3. The apparatus of claim 1, wherein said body is formed of polycarbonate, and said cap is formed of nylon.

4. The apparatus of claim 1, wherein said body and said cap coordinate to dissipate energy applied to said apparatus by said animal without causing said cap to separate from said body.

5. The apparatus of claim 1, wherein said body is substantially smooth and featureless so as to frustrate said animal in applying force thereto.

6. Bear excluding container apparatus, comprising:

a molded body having an interior volume and an aperture formed therein, said body further comprising first threads and being adapted to withstand forces exerted by said bear;

a molded cap having a locking element associated therewith and second threads, said cap being retained on said body through at least cooperation of said first and second threads; and at least one exclusion ridge formed on said body proximate said first threads, said at least one ridge being adapted to substantially shield a gap created between said cap and said body when said cap is threaded at least partly onto said body;

wherein access to said volume by said bear is frustrated by said locking element, said body, said ridge, and said cap.

7. The apparatus of claim 6, wherein said locking element is adapted to require at least some distortion of at least one of said molded cap or body for said cap to be threadably removed from said body.

8. The apparatus of claim 6, wherein said body is substantially comprised of polycarbonate, and said cap is substantially comprised of a nylon-based polymer.

9. Bear excluding apparatus, comprising:

a body having an interior volume and an aperture formed therein, said aperture having a diameter nearly the full diameter of the body;

a threaded cap having at least one locking means associated therewith;

wherein said cap threads onto or off said body by the action of a human; and ridge means formed proximate said cap, said ridge means having a diameter larger than an outside diameter of said cap and having a region extending upward beyond a lower edge of said cap when said cap is fully threaded onto said body;

wherein said body, ridge means, locking means and cap cooperate to exclude said bear from said interior volume.

10. The apparatus of claim 9, wherein said cap comprises a lower edge, said lower edge mating substantially flush with a corresponding surface of said body so as to substantially eliminate any gap there between.

11. The apparatus of claim 9, wherein said body is formed of polycarbonate, and said cap is formed of nylon.

12. The apparatus of claim 9, wherein said body and said cap coordinate to dissipate energy applied to said apparatus by said bear without causing said cap to separate from said body.

13. The apparatus of claim 9, wherein said body is substantially smooth and featureless so as to frustrate said animal in applying force thereto.

14. Bear excluding container apparatus, comprising:

a molded body having an interior volume and an aperture formed therein, said body further comprising first threads and being adapted to withstand forces exerted by said bear;

a molded cap having locking means associated therewith and second threads, said cap being retained on said body through at least cooperation of said first and second threads; and at least one exclusion means formed on said body proximate said first threads, said at least one exclusion means being adapted to substantially shield a gap created between said cap and said body when said cap is threaded at least partly onto said body;

wherein access to said volume by said bear is frustrated by said locking means, said body, said exclusion means, and said cap.

15. The apparatus of claim 14, wherein said locking means is adapted to require at least some distortion of at least one of said molded cap or body for said cap to be threadably removed from said body.

16. The apparatus of claim 14, wherein said body is substantially comprised of polycarbonate, and said cap is substantially comprised of a nylon-based polymer.

17. Bear excluding apparatus, comprising:

a body comprising an interior volume, a first locking element and an aperture formed therein, said aperture having a diameter nearly the full diameter of the body;

a threaded cap having a second locking element associated therewith;

wherein said cap threads onto or off said body by the action of a human; and a ridge formed proximate said cap, said ridge having a diameter larger than an outside diameter of said cap and having a region extending upward beyond a lower edge of said cap when said cap is fully threaded onto said body;

wherein said body, ridge, first and second locking elements, and said cap cooperate to exclude said bear from said interior volume.

18. The apparatus of claim 17, wherein said cap comprises a lower edge, said lower edge mating substantially flush with a corresponding surface of said body so as to substantially eliminate any gap there between.

19. The apparatus of claim 17, wherein said body comprises polycarbonate, and said cap comprises nylon.

20. The apparatus of claim 17, wherein said body and said cap coordinate to dissipate energy applied to said apparatus by said animal without causing said cap to separate from said body.

21. The apparatus of claim 17, wherein said body is substantially smooth and featureless so as to frustrate said bear in applying force thereto.

22. Bear excluding container apparatus, comprising:

a molded body having an interior volume and an aperture formed therein, said body further comprising first threads and being adapted to withstand forces exerted by said bear;

a molded cap having a locking element associated therewith and second threads, said cap being retained on said body through at least cooperation of said first and second threads; and at least one exclusion ridge formed on said body proximate said first threads, said at least one ridge being adapted to substantially shield a gap created between said cap and said body when said cap is threaded at least partly onto said body;

wherein access to said volume by said bear is frustrated by said locking element, said body, said ridge, and said cap; and wherein said locking element prevents said cap from being unthreaded enough to expose said gap unless said molded cap undergoes at least some distortion so that said cap may be unthreaded from said body.

23. The apparatus of claim 22, wherein said body is substantially comprised of polycarbonate, and said cap is substantially comprised of a nylon-based polymer.

24. The apparatus of claim 22, further comprising a plurality of surface elements disposed on an exterior surface of said body, said surface elements adapted to provide retention of one or more restraining devices.

25. The apparatus of claim 22, wherein said molded body, cap and ridge cooperate to substantially restrict moisture intrusion into said interior volume of said molded body.

* * * * *